US007424872B2

(12) United States Patent
Fuwa et al.

(10) Patent No.: US 7,424,872 B2
(45) Date of Patent: Sep. 16, 2008

(54) FAILURE DIAGNOSTIC APPARATUS FOR VARIABLE VALVE MECHANISM OF INTERNAL COMBUSTION ENGINE AND FAILURE DIAGNOSTIC METHOD FOR VARIABLE VALVE MECHANISM

(75) Inventors: Naohide Fuwa, Toyota (JP); Harufumi Muto, Ann Arbor, MI (US)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 242 days.

(21) Appl. No.: 11/035,078

(22) Filed: Jan. 14, 2005

(65) Prior Publication Data

US 2005/0154522 A1 Jul. 14, 2005

(30) Foreign Application Priority Data

Jan. 14, 2004 (JP) ..... 2004-007132

(51) Int. Cl.
*F01L 1/34* (2006.01)

(52) U.S. Cl. ..... 123/90.15; 123/90.16; 123/90.17; 123/345; 123/347

(58) Field of Classification Search ..... 123/90.15, 123/90.16, 90.17, 90.18, 90.27, 90.31, 345, 123/346, 347, 348; 251/12, 30.02, 129.01, 251/129.02, 129.15, 129.16
See application file for complete search history.

(56) References Cited

U.S. PATENT DOCUMENTS 6,390,041 B2 * 5/2002 Nakamura et al. ..... 123/90.15
6,405,697 B2 * 6/2002 Mikame ..... 123/90.18
6,425,357 B2 * 7/2002 Shimizu et al. ..... 123/90.16

FOREIGN PATENT DOCUMENTS

| | | | |
|---|---|---|---|
| DE | 195 48 389 A | | 6/1997 |
| DE | 196 20 172 A1 | | 11/1997 |
| DE | 196 43 711 A1 | | 4/1998 |
| DE | 198 31 486 A1 | | 1/2000 |
| EP | 0 957 239 A1 | | 11/1999 |
| JP | A-2000-314329 | | 11/2000 |
| JP | 2002054466 A | * | 2/2002 |
| JP | A-2002-054466 | | 2/2002 |
| JP | A-2002-238288 | | 8/2002 |

* cited by examiner

*Primary Examiner*—Ching Chang
(74) *Attorney, Agent, or Firm*—Kenyon & Kenyon LLP

(57) ABSTRACT

A failure diagnosis for a slide sensor of a variable valve mechanism is performed when a valve working angle is at a value in the initial state. The initial state is set to a valve characteristic state where the valve working angle is at the maximum value. The maximum valve working angle corresponds to the refuge running performable region in which an engine can be started and refuge running can be performed. Therefore, even when it is difficult to adjust the valve working angle using rotation of a spiral cam due to a failure in the slide sensor, the refuge running can be performed only by maintaining the initial state by maintaining control. It is thus possible to increase reliability of the refuge running in the case where a failure has occurred in the variable valve mechanism.

9 Claims, 22 Drawing Sheets

FAILURE DIAGNOSTIC APPARATUS FOR VARIABLE VALVE MECHANISM OF INTERNAL COMBUSTION ENGINE AND FAILURE DIAGNOSTIC METHOD FOR VARIABLE VALVE MECHANISM

INCORPORATION BY REFERENCE

The disclosure of Japanese Patent Application No. 2004-007132 filed on Jan. 14, 2004, including the specification, drawings and abstract is incorporated herein by reference in its entirety.

BACKGROUND OF THE INVENTION

1. Field of the Invention

The invention relates to a failure diagnostic apparatus for a variable valve mechanism which detects a valve characteristic value of an internal combustion engine by using a sensor, and which adjusts the valve characteristic value based on the detected valve characteristic value, and a failure diagnostic method for the variable valve mechanism.

2. Description of the Related Art

There is a known variable valve mechanism which adjusts an intake air amount by changing a valve working angle in order to improve fuel efficiency in an internal combustion engine. In such a variable valve mechanism, there are provided an actuator for driving the mechanism and a sensor for detecting an adjustment state of the valve working angle. However, when a failure occurs in the actuator or the sensor, the valve working angle cannot be adjusted. As a result, in some cases, the internal combustion engine stops due to a decrease in the intake air amount and refuge running cannot be performed. In order to address problem, a technology is proposed in which whether a failure has occurred in an actuator or a sensor is determined, and when it is determined that a failure has occurred, a valve working angle is changed such that the refuge running can be performed. For example, Japanese Patent Laid-Open Publication No. 2000-314329, i.e., JP-A-2000-314329 (refer to pages 6 to 7, and FIG. 11) discloses a technology. In this technology, when there is an abnormality in a sensor, a valve working angle is estimated based on an operating state of an internal combustion engine, and an actuator of a variable valve mechanism is driven such that the valve working angle becomes a target value for the case where a failure has occurred.

In the above-mentioned technology, the valve working angle is estimated based on the operating state of the internal combustion engine. Therefore, when a failure in the sensor is detected, the internal combustion engine needs to be operating actually. If the operation of the internal combustion engine has been stopped or the internal combustion engine is in a transition state when it is determined that a failure has occurred in the sensor, the valve working angle cannot be changed to the target value. Accordingly, there is a high possibility that it will become difficult to start the internal combustion engine or to operate the internal combustion engine continuously and stably, making it impossible to perform the refuge running.

Further, if a failure has occurred in the actuator instead of in the sensor and the valve working angle cannot be changed, it becomes impossible to increase an output of the engine by increasing the valve working angle and to perform the refuge running. Also, a force supplied from a valve side is applied such that the valve working angle is decreased, depending on a structure of the variable valve mechanism. However, when a failure has occurred in the actuator, it becomes impossible to resist this force. Therefore, the internal combustion engine is stopped, afterwhich it is impossible to start the internal combustion engine and perform the refuge running.

SUMMARY OF THE INVENTION

It is an object of the invention to increase reliability of refuge running when a failure has occurred in a variable valve mechanism. The term "refuge running" as used herein is defined to mean running of a vehicle at a reduced level of performance due to a failure in the vehicle, which will allow the driver to drive the vehicle to a safe place or a service garage for repair.

A first aspect of the invention relates to a failure diagnostic apparatus for a variable valve mechanism which detects a valve characteristic value, that is, at least one of a valve lift amount and a valve working angle of an internal combustion engine by using a sensor, and which adjusts the valve characteristic value based on the detected valve characteristic value. The failure diagnostic apparatus includes a failure diagnostic device that performs a failure diagnosis for the variable valve mechanism when it is determined that the valve characteristic value is in a refuge running performable region, which is set in a range where the valve characteristic value can be adjusted by the variable valve mechanism; and a valve state maintaining device that performs maintaining control for maintaining the valve characteristic value at a value in the refuge running performable region, when the failure diagnostic device determines that a failure has occurred in the variable valve mechanism.

The failure diagnostic device performs the failure diagnosis for the variable valve mechanism when the valve characteristic value is at a value in the refuge running performable region. When it is determined that there is an abnormality in the variable valve mechanism, the valve state maintaining device performs the maintaining control.

In the maintaining control, the valve characteristic value is maintained at a value in the refuge running performable region. As mentioned above, the failure diagnosis is performed when the valve characteristic value is at a value in the refuge running performable region. Accordingly, when the valve characteristic value is maintained at a value in the refuge running performable region in the maintaining control, the valve characteristic value need not be adjusted and is maintained as it is. It is therefore possible to perform the maintaining control even when a failure has occurred in the variable valve mechanism.

A second aspect of the invention relates to a failure diagnostic method for a variable valve mechanism for detecting a valve characteristic value, that is, at least one of a valve lift amount and a valve working angle of an internal combustion engine by using a sensor, and for adjusting the valve characteristic value based on the detected valve characteristic value. This method includes a step of determining whether the valve characteristic value is at a value in a refuge running performable region which is set in a range where the valve characteristic value can be adjusted by the variable valve mechanism; a step of performing a failure diagnosis for the variable valve mechanism when it is determined that the valve characteristic value is at a value in the refuge running performable region; and a step of maintaining the valve characteristic value at a value in the refuge running performable region when it is determined that a failure has occurred in the variable valve mechanism.

According to this failure diagnostic method, when it is determined that a failure has occurred in the variable valve mechanism, it is possible to maintain the valve characteristic value at a value in the refuge running performable region.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
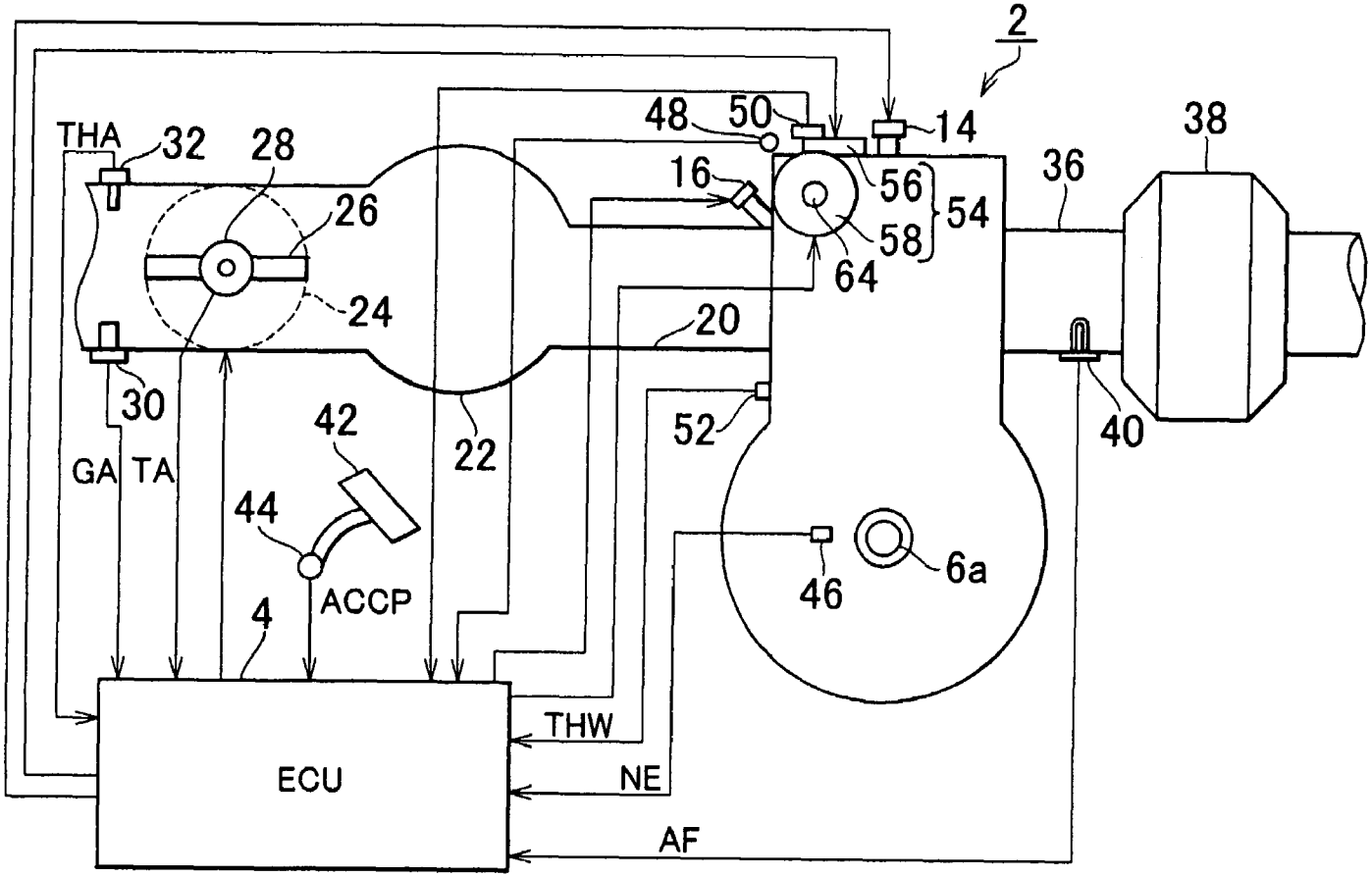
FIG. 1 is a view schematically showing an engine and an ECU according to an embodiment.
Figure 2:
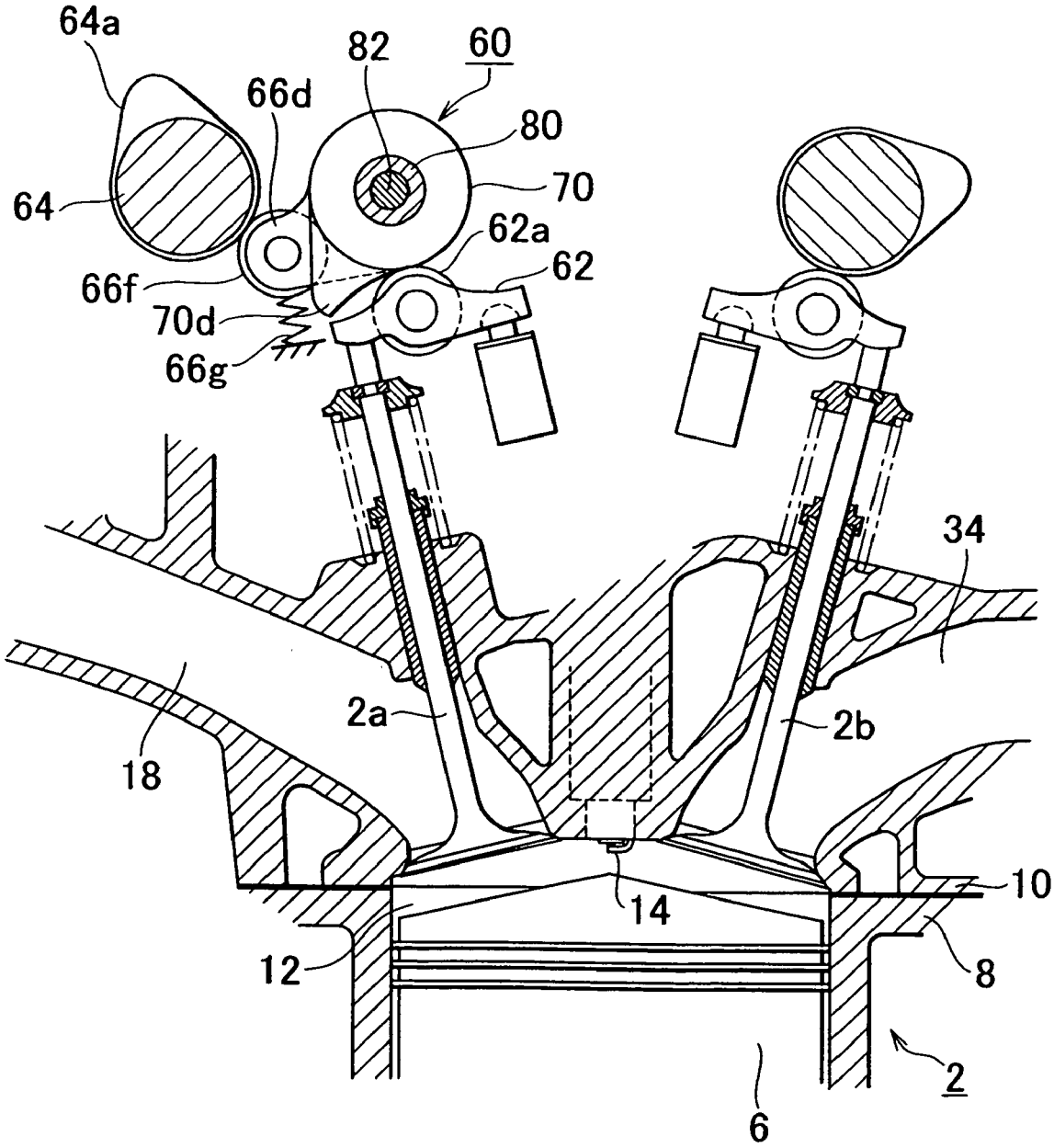
FIG. 2 is a longitudinal section view showing a variable valve system of the engine.

Hereafter, a first embodiment of the invention will be described in detail with reference to accompanying drawings. FIG. 1 is a view schematically showing a structure of a gasoline engine (hereinafter, simply referred to as an "engine") 2 as an internal combustion engine mounted in a vehicle and an electronic control unit (hereinafter, simply referred to as an "ECU") 4 as a control unit. The engine 2 is a multi-cylinder engine, that is, a four-cylinder engine in the embodiment. FIG. 2 is a longitudinal section view showing a variable valve system of one cylinder from among the four cylinders. Each cylinder is provided with two intake valves 2*a* and two exhaust valves 2*b*, and the engine is formed as a four-valve engine. Note that the number of cylinders may be six or eight, and the engine may be a two-valve engine or a five-valve engine.

An output from the engine 2 is transferred to a wheel via a transmission as a driving force for running. In the engine 2, a combustion chamber 12, which is surrounded by a piston 6, a cylinder block 8 and a cylinder head 10, is formed. The cylinder head 10 is provided with a spark plug 14 for igniting an air-fuel mixture in the combustion chamber 12, and a fuel injection valve 16 (refer to FIG. 1) for directly injecting fuel into the combustion chamber 12. Note that the fuel injection valve 16 may inject fuel into an intake port 18 connected to the combustion chamber 12.

The intake port 18 is opened/closed by driving of the intake valve 2*a*, and an intake passage 20 connected to the intake port 18 is connected to a surge tank 22. A throttle valve 26 whose opening amount (throttle valve opening amount TA) is adjusted by a motor 24 is provided upstream of the surge tank 22. The throttle valve 26 is substantially fully open in the normal state. However, the throttle valve opening amount TA is controlled in order to adjust an intake air amount GA depending on the state of the engine 2. For example, as described later, when a failure in a variable valve mechanism 54 is detected and a valve working angle of the intake valve 2*a* is maintained at a value in an initial state, the refuge running can be performed by adjusting the throttle valve opening amount TA. The throttle valve opening amount TA is detected by a throttle valve opening amount sensor 28 and read by the ECU 4. The intake air amount GA is detected by an intake air amount sensor 30 provided upstream of the throttle valve 26, and an intake air temperature THA is detected by an intake air temperature sensor 32 provided upstream of the throttle valve 26. The detected intake air amount GA and the detected intake air temperature THA are read by the ECU 4.

An exhaust port 34 connected to the combustion chamber 12 is opened/closed by driving of the exhaust valve 2*b*. An exhaust gas control catalytic converter 38 is provided in an exhaust passage 36 connected to the exhaust port 34. An air-fuel ratio AF is detected, based on components of exhaust gas in the exhaust passage 36, by an air-fuel ratio sensor 40 provided in the exhaust passage 36 arranged upstream from the exhaust gas control catalytic converter 38, and the detected air-fuel ratio AF is read by the ECU 4.

The ECU 4 is an engine control circuit mainly including a digital computer. Signals not only from the above-mentioned throttle valve opening sensor 28, the intake air amount sensor 30, the intake air temperature sensor 32, and the air-fuel ratio sensor 40 but also from various sensors for detecting an operating state of the engine 2 are input in the ECU 4. Namely, signals from an accelerator pedal operation amount sensor 44 for detecting an amount of depression of an accelerator pedal 42 (an accelerator pedal operation amount ACCP), an engine rotational speed sensor 46 for detecting an engine rotational speed NE based on rotation of a crank shaft 6*a*, and a reference crank angle sensor 48 for deciding a reference crank angle based on rotation of a cam shaft are input in the ECU 4. Also, signals from a slide sensor 50 for detecting a valve working angle of the intake valve 2*a*, and a coolant temperature sensor 52 for detecting an engine coolant temperature THW are input in the ECU 4. In addition to these sensors, sensors for detecting various types of data are provided.

In the embodiment, a valve lift amount also changes in accordance with a change in the valve working angle. Therefore, the slide sensor 50 also serves as a sensor for detecting the valve lift amount. Hereafter, the description about adjustment and behavior concerning the valve working angle is also used for the description about adjustment and behavior concerning the valve lift amount.

The ECU 4 controls fuel injection timing, a fuel injection amount, the throttle valve opening amount TA, ignition timing, and the like of the engine 2, as appropriate, based on the values detected by the above-mentioned sensors, by supplying control signals to the fuel injection valve 16, the throttle valve motor 24, and the spark plug 14. In addition, the ECU 4 controls the valve working angle and valve timing of the intake valve 2*a* based on the accelerator pedal operation amount ACCP and the engine rotational speed NE, by supplying a control signal to the variable valve mechanism 54 for adjusting the valve working angle and valve timing of the intake valve 2*a*. The intake air amount is adjusted by adjusting mainly the valve working angle.

The variable valve mechanism 54 includes a valve working angle adjusting mechanism 56 and a valve timing adjusting mechanism 58. The valve working angle adjusting mechanism 56 includes an intermediary drive mechanism 60 shown in FIG. 2 to FIG. 5, and a shaft slide mechanism 100 shown in FIG. 9.

As shown in FIG. 2, the intermediary drive mechanism 60 is provided between a roller rocker arm 62 provided for the intake valve 2*a* and an intake cam 64*a* provided for an intake cam shaft 64. The intermediary drive mechanism 60 drives the intake valve 2*a* by supplying a valve driving force from the intake cam 64*a* to the roller rocker arm 62.

Figure 3:
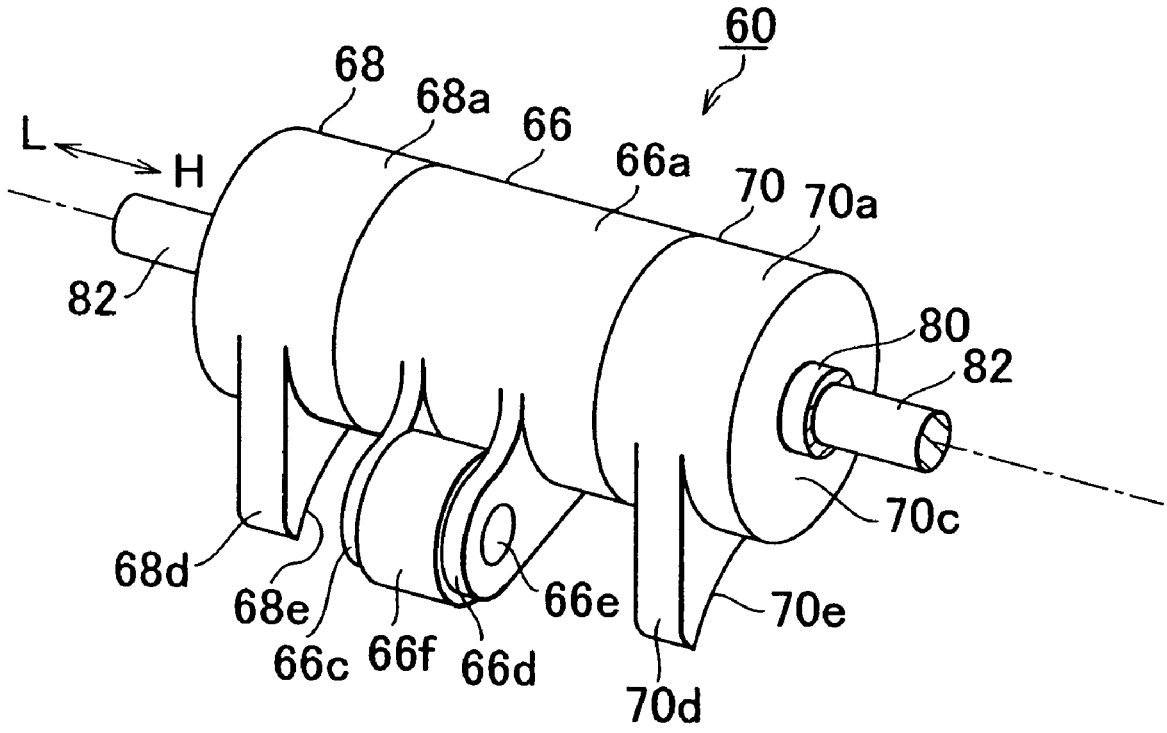
FIG. 3 is a perspective view showing an intermediary drive mechanism of the variable valve system.
Figure 4:
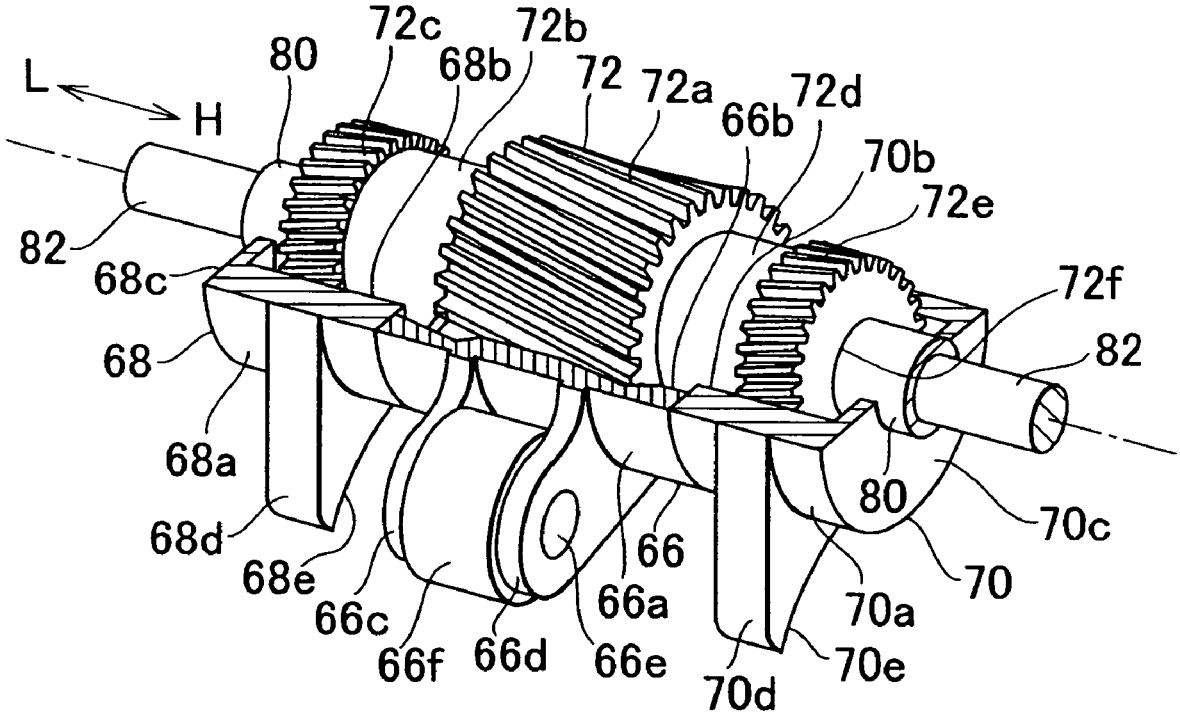
FIG. 4 is a perspective view showing the intermediary drive mechanism cut away in a horizontal direction.
Figure 5:
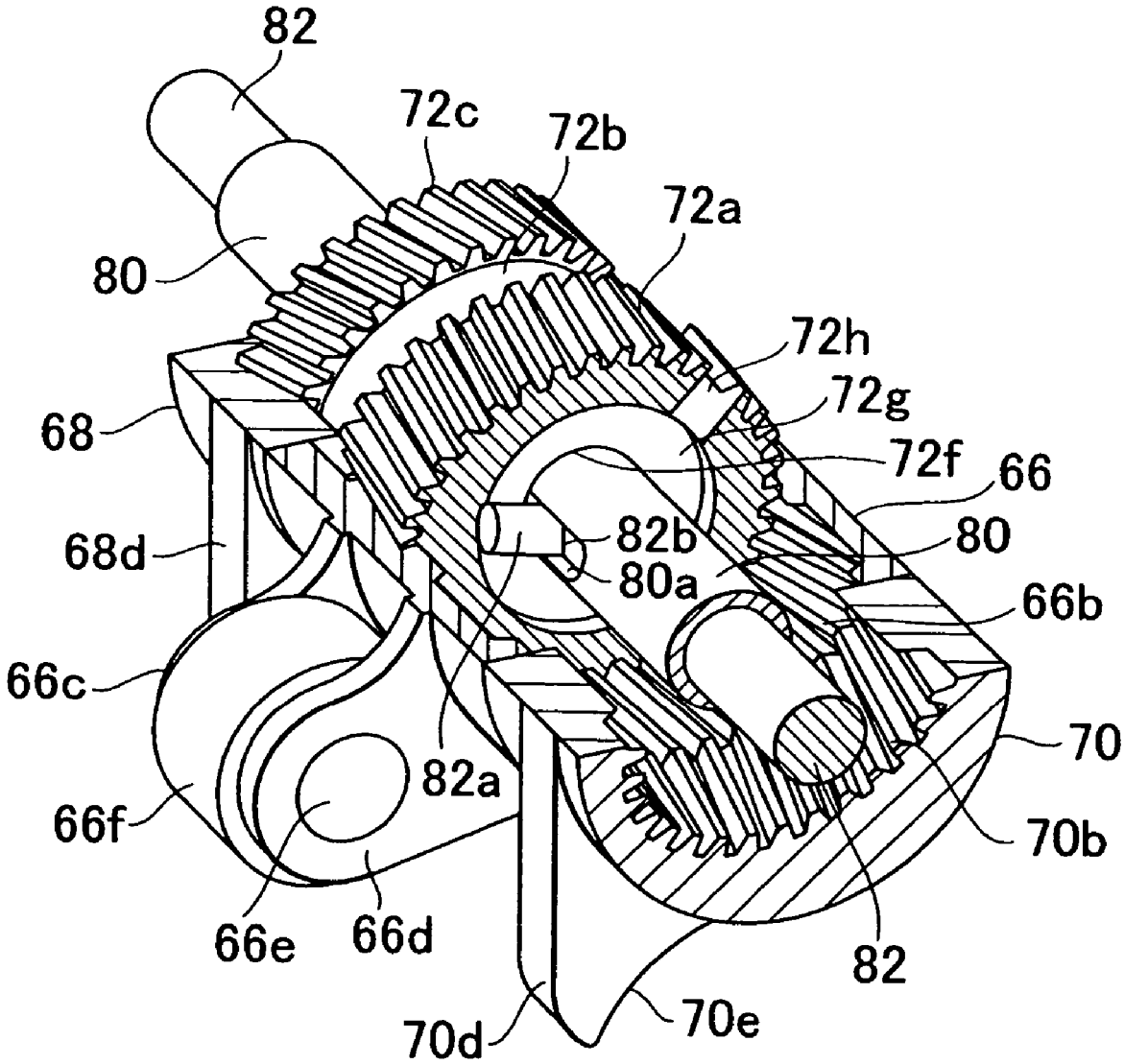
FIG. 5 is a perspective showing the intermediary drive mechanism cut away in the horizontal and vertical directions.

As shown in the perspective view in FIG. 3 and the perspective view cut away in the horizontal direction in FIG. 4, the intermediary drive mechanism 60 provided for each cylinder includes an input portion 66 provided at a center of the intermediary drive mechanism 60; a first oscillating cam 68 provided on one end side of the input portion 66, and a second oscillating cam 70 provided on the opposite end side from the first oscillating cam 68, and a slider gear 72 provided inside the intermediary drive mechanism 60.

Inside a housing 66*a* of the input portion 66, a space is formed in the axial direction. On an inner peripheral surface, a helical spline 66*b* having a spiral shape of a right-hand screw is formed in the axial direction. Two arms 66*c* and 66*d*, which are parallel to each other, protrude from an outer surface of the housing 66*a*. A roller 66*f* having a shaft 66*e*, which is parallel to the axis of the housing 66*a*, is rotatably attached to the arms 66*c* and 66*d* at ends thereof. As shown in FIG. 2, an urging force of a spring 66*g* is supplied to the arms 66*c* and 66*d* or the housing 66*a* such that the roller 66*f* contacts the intake cam 64*a* side at all times.

Inside a housing 68*a* of the first oscillating cam 68, a space is formed in the axial direction. On an inner peripheral surface, a helical spline 68*b* having a spiral shape of a left-hand screw is formed in the axial direction. One end of the housing 68*a* is covered with a ring-shaped bearing portion 68*c* having a small-diameter center hole. Also, a substantially triangle nose 68*d* protrudes from an outer surface of the housing 68*a*. One side of the nose 68*d* forms a concavely curved cam surface 68*e*.

Inside a housing 70*a* of the second oscillating cam 70, a space is formed in the axial direction. On an inner peripheral surface, a helical spline 70*b* having a spiral shape of a left-hand screw is formed in the axial direction. One end of the housing 70*a* is covered with a ring-shaped bearing portion 70*c* having a small-diameter center hole. Also, a substantially triangle nose 70*d* protrudes from an outer surface of the housing 70*a*. One side of the nose 70*d* forms a concavely curved cam surface 70*e*.

The first oscillating cam 68 and the second oscillating cam 70 are provided so as to contact the input portion 66 using the same axis. Namely, one end surface of the first oscillating cam 68 contacts one end surface of the input portion 66 and one end surface of the second oscillating cam 70 contacts the other end surface of the input portion 66 on the same axis. The bearing portions 68*c* and 70*c* are used as the outer end surface of the first oscillating cam 68 and the second oscillating cam 70, respectively. The first oscillating cam 68, the second oscillating cam 70, and the input portion 66 form a substantial cylinder having an inner space, as shown in FIG. 3.

In the inner space formed by the input portion 66, the two oscillating cams 68 and 70, the slider gear 72 is provided. The slider gear 72 has a substantially cylindrical shape. At the center portion of the outer surface of the slider gear 72, an input helical spline 72*a* having a spiral shape of a right-hand screw is formed. On one end side of the input helical spline 72*a*, a first output helical spline 72*c* having a spiral shape of a left-hand screw is formed, and there is a small-diameter portion 72*b* between the input helical spline 72*a* and the first output helical spline 72*c*. On the other end side of the input helical spline 72*a*, which is the opposite from the side on which the first output helical spline 72*c* is formed, a second output helical spline 72*e* having a spiral shape of a left-hand screw is formed, and there is a small-diameter portion 72*d* between the input helical spline 72*a* and the second output helical spline 72*e*. Note that the outer diameter of each of the output helical splines 72*c* and 72*e* is smaller than the outer diameter of the input helical spline 72*a*.

Inside the slider gear 72, a through hole 72*f* is formed in the central axis direction. As shown in a longitudinal section view in FIG. 5, a circumferential groove 72*g* is formed on an inner peripheral surface of the through hole 72*f* in the circumferential direction at the position of the input helical spline 72*a*. In the circumferential groove 72*g*, a pin insertion hole 72*h*, which permits communication with the outside, is formed at one portion in the radial direction.

A support pipe 80 is provided inside the through hole 72*f* of the slider gear 72 so as to be slidable in the circumferential direction. One support pipe 80 is provided for the intermediary drive mechanisms 60 for all the cylinders. A long hole 80*a*, which is formed so as to be long in the axial direction, is formed in the support pipe 80 at a position corresponding to each intermediary drive mechanism 60.

In addition, in the support pipe 80, a control shaft 82 is slidably provided so as to penetrate the support pipe 80 in the axial direction. A support hole 82*b* is provided in a direction perpendicular to the axial direction at a position corresponding to each long hole 80*a* of the support pipe 80. A base end portion of a control pin 82*a* is inserted in the support hole 82*b*, and the control pin 82*a* is supported so as to protrude in the direction perpendicular to the axial direction.

In the state where the control shaft 82 is provided inside the support pipe 80, an end of each control pin 82*a* penetrates the long hole 80*a* formed in the support pipe 80 in the axial direction, and inserted in the circumferential groove 72*g* formed on the inner peripheral surface of the slider gear 72.

Due to such a structure, each slider gear 72 can be moved in the axial direction in accordance with a movement of the control shaft 82. The position of the slider gear 72 in each intermediary drive mechanism 60 can be decided by controlling the position of the control shaft 82. However, each slider gear 72 can move in the circumferential direction regardless of the position of the control pin 82*a*, since each slider gear 72 is stopped at the circumferential groove 72*g* by the control pin 82*a*.

In the slider gear 72, the input helical spline 72*a* is meshed with the helical spline 66*b* in the input portion 66. The first output helical spline 72*c* is meshed with the helical spline 68*b* in the first oscillating cam 68. The second output helical spline 72*e* is meshed with the helical spline 70*b* in the second oscillating cam 70.

Each intermediary drive mechanism 60 is attached on the cylinder head 10 at the bearing portions 68*c* of the oscillating cam 68 and the bearing portion 70*c* of the oscillating cam 70 such that a movement in the axial direction is prevented. Therefore, even when the control shaft 82 moves the slider gear 72 in the axial direction, the input portion 66, and the oscillating cams 68 and 70 do not move in the axial direction.

Accordingly, a phase difference between the input portion 66 and the oscillating cams 68 and 70 can be changed using the functions of the helical splines 72*a*, 66*b*, 72*c*, 68*b*, 72*e*, and 70*b*, by adjusting the amount of movement of the slider gear 72 in the axial direction in the inner space of the intermediary drive mechanism 60. Thus, the positional relationship between the roller 66*f* and the noses 68*d* and 70*d* can be changed.

Figure 6B:
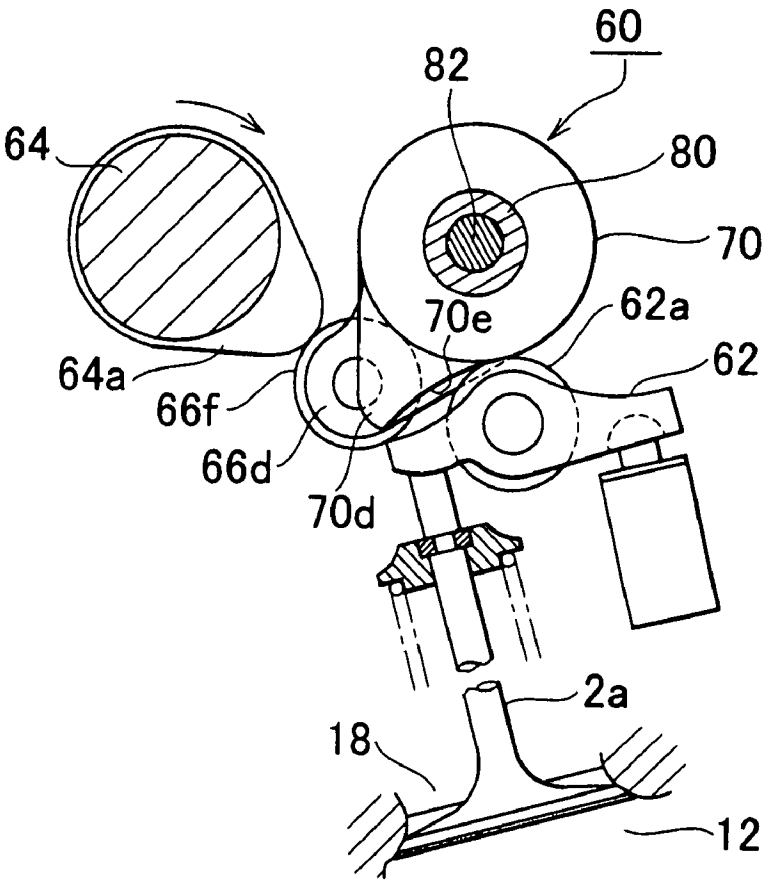
FIGS. 6A and 6B are views for describing driving of the intermediary drive mechanism when a valve working angle and a valve lift amount are at the minimum values.
Figure 6A:
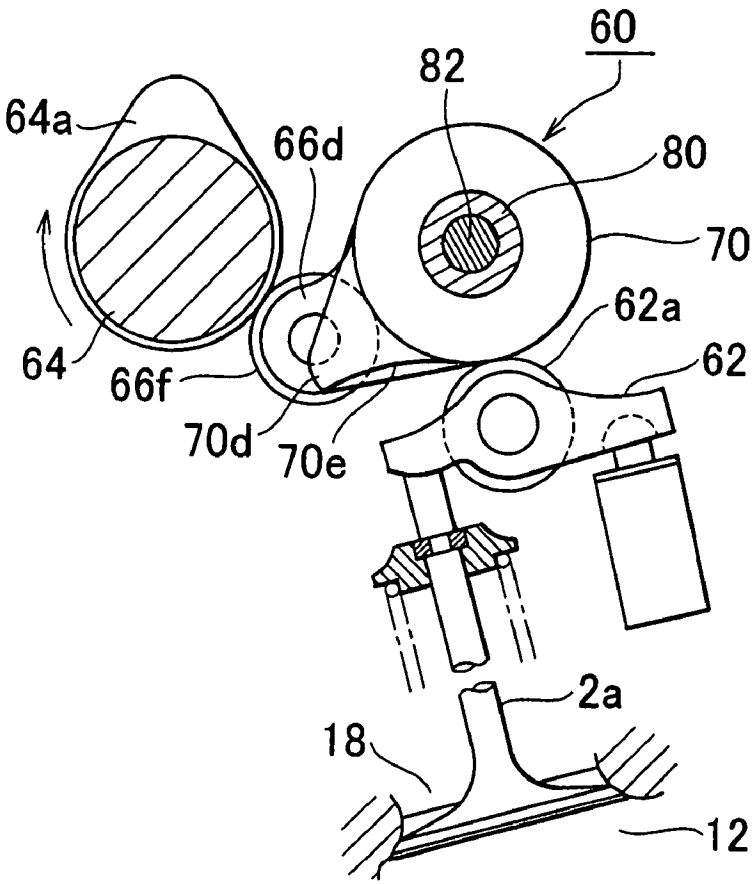

FIGS. 6A and 6B show the operating state of the intermediary drive mechanism 60 when the control shaft 82 is moved to the fullest extent in an L direction (refer to an arrow in FIGS. 3 and 4). FIG. 6A shows the case where the cam shaft 64 is in a position corresponding to the closed position of the valve, and FIG. 6B shows the case where the cam shaft 64 is in a position corresponding to the open position of the valve. In this case, the relative distance between the roller 66*f* of the input portion 66 and the noses 68*d* and 70*d* of the oscillating cams 68 and 70 become the shortest. Accordingly, as shown in FIG. 6B, even when the intake cam 64*a* depresses the roller 66*f* of the input portion 66 to the fullest extent, the amount of depression of a rocker roller 62*a* by the cam surfaces 68*e* and 70*e* of the noses 68*d* and 70*d* becomes the minimum value. In this case, the amount of depression is "0". Accordingly, the valve working angle (the range of the crank angle from when the valve is opened until when the valve is closed) of the intake valve 2*a* is "0". Therefore, the intake valve 2*a* is kept closed, and the amount of air taken in the combustion chamber 12 from the intake port 18 is "0".

Figure 7B:
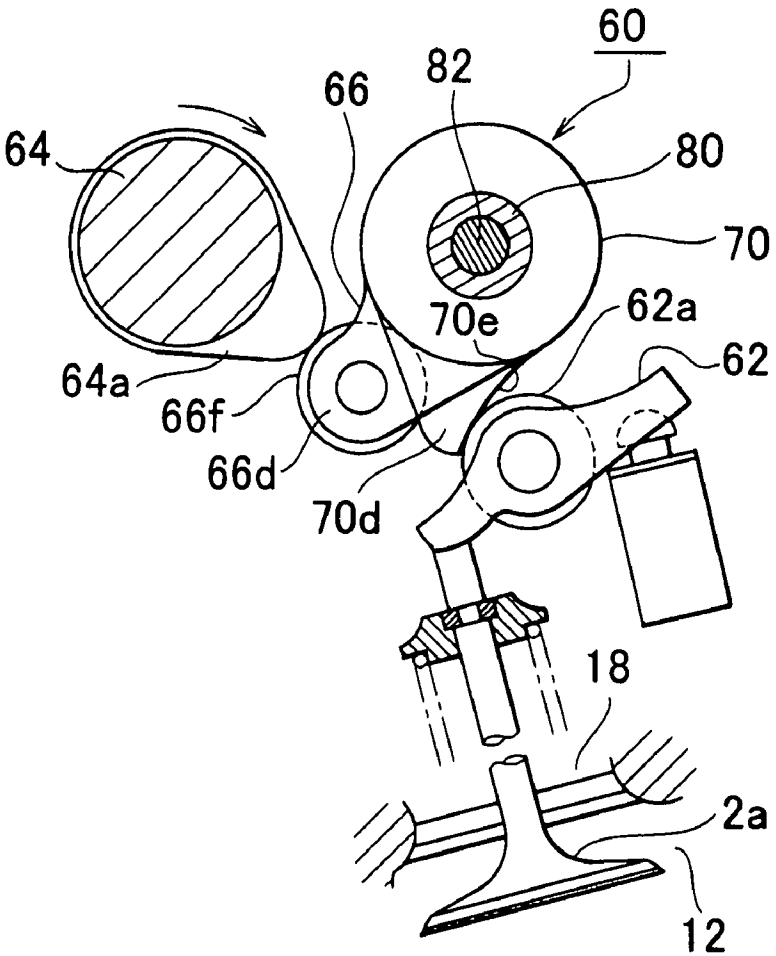
FIGS. 7A and 7B are view for describing driving of the intermediary drive mechanism when the valve working angle and the valve lift amount are at the maximum values.
Figure 7A:
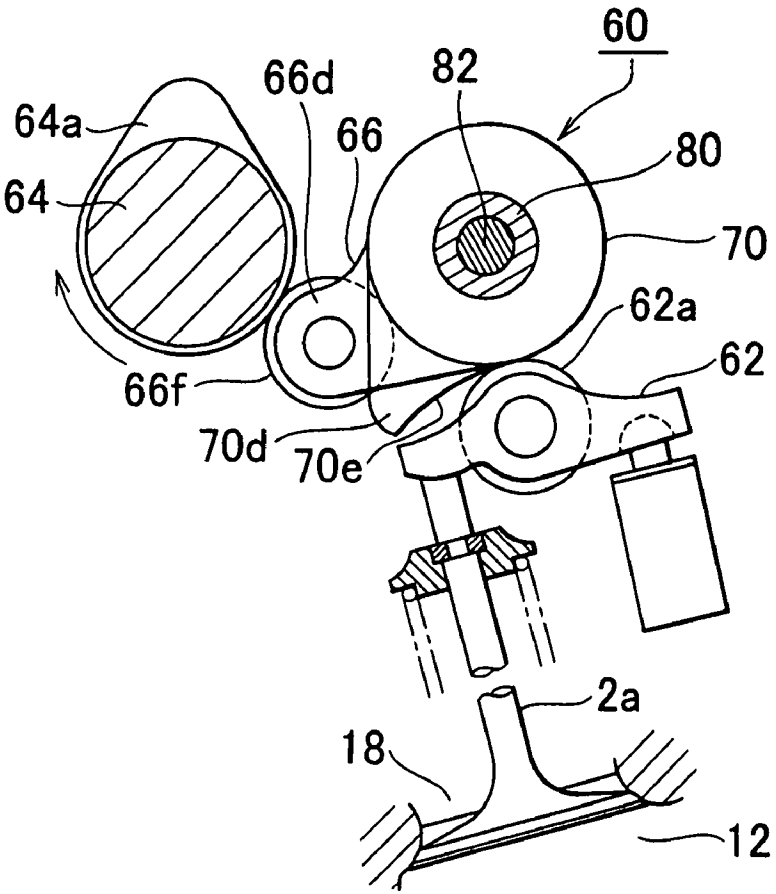

FIGS. 7A and 7B show the operating state of the intermediary drive mechanism 60 when the control shaft 82 is moved to the fullest extent in an H direction (refer to an arrow in FIGS. 3 and 4). FIG. 7A shows the case where the valve is closed, and FIG. 7B shows the case where the valve is open. In this case, the relative distance between the roller 66*f* of the input portion 66 and the noses 68*d* and 70*d* of the oscillating cams 68 and 70 become the longest. Accordingly, as shown in FIG. 7B, when the intake cam 64*a* depresses the roller 66*f* of the input portion 66 to the fullest extent, the amount of depression of the rocker roller 62*a* by the cam surfaces 68*e* and 70*e* of the noses 68*d* and 70*d* becomes the maximum value, and the valve working angle of the intake valve 2*a* becomes the maximum value. Accordingly, unlike the case shown in FIGS. 6A and 6B, the intake valve 2*a* opens to the fullest extent during the intake stroke, and the amount of air taken in the combustion chamber 12 from the intake port 18 becomes the maximum value.

Figure 8:
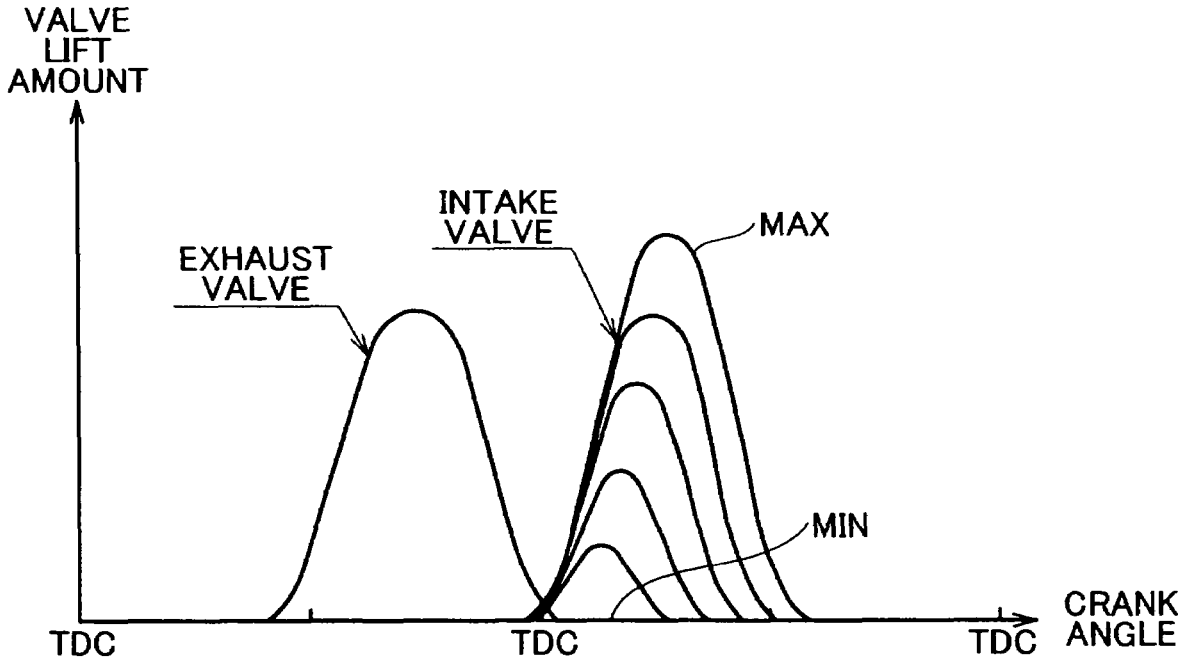
FIG. 8 is a graph showing changes in the valve working angle and the valve lift amount caused by the intermediary drive mechanism.

By adjusting the position of the control shaft 82 in the axial direction, the valve working angle of the intake valve 2*a* can be continuously adjusted between the state shown in FIGS. 6A and 6B and the state shown in FIGS. 7A and 7B. The continuous adjustment state of the valve working angle is shown in a graph in FIG. 8. The state shown by MIN in FIG. 8 corresponds to the state shown in FIGS. 6A and 6B. In this state, the intake valve 2*a* is not open even during the intake stroke. The state shown by MAX in FIG. 8 corresponds to the state shown in FIGS. 7A and 7B. In this state, the valve working angle becomes the maximum value during the intake stroke. Thus, the intake air amount can be adjusted without using the throttle valve 26. Note that FIG. 8 shows the case where the valve timing is also changed by the valve timing adjusting mechanism 58.

Figure 9:
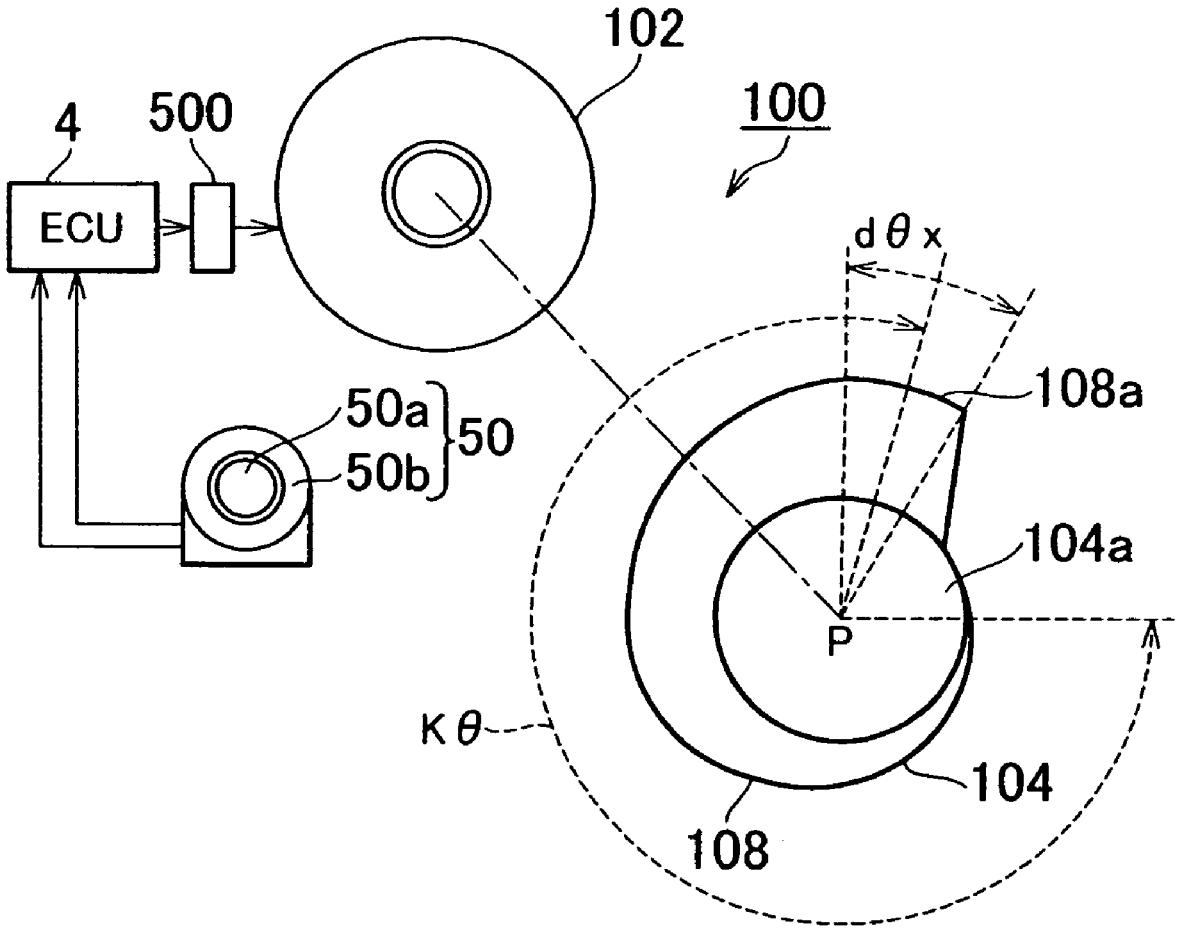
FIG. 9 is a view showing a structure of a shaft slide mechanism in a first embodiment and a second embodiment.

FIG. 9 shows the shaft slide mechanism 100 for moving the control shaft 82 in the axial direction. The shaft slide mechanism 100 includes a drive motor 102 (which can be regarded as an actuator), a spiral cam 104 (which can be regarded as a control shaft position adjusting mechanism), and the slide sensor 50 (which can be regarded as a sensor for detecting a valve characteristic value by the control shaft).

The drive motor 102 is fixed to the cylinder head 10, and the electric power supply from a battery 500 corresponding to a driving force supply source is controlled according to a drive signal output from the ECU 4. Thus, the drive motor 102 can rotate a cam shaft 104*a* and change a rotational phase of the spiral cam 104. The drive motor 102, may directly rotate the spiral cam 104, or may rotate the spiral cam 104 via a gear such that the rotational speed is reduced. The range of rotation of the spiral cam 104 is limited to a range Kθ which is smaller than 360°. If the spiral cam 104 attempts to rotate such that the range of rotation exceeds the range Kθ, the rotation of the cam shaft 104*a* is mechanically prevented by a stopper.

As shown in FIGS. 12A to 12D, a detection rod 50*a* of the slide sensor 50 is fixed to a cam frame 110 provided at one end of the control shaft 82. The ECU 4 detects a valve working angle of the intake valve 2*a* by measuring an amount of movement of the cam frame 110, which moves in accordance with a movement of the control shaft 82, using a detection coil 50*b* of the slide sensor 50, that is fixed on the cylinder head 10 side.

Figure 10:
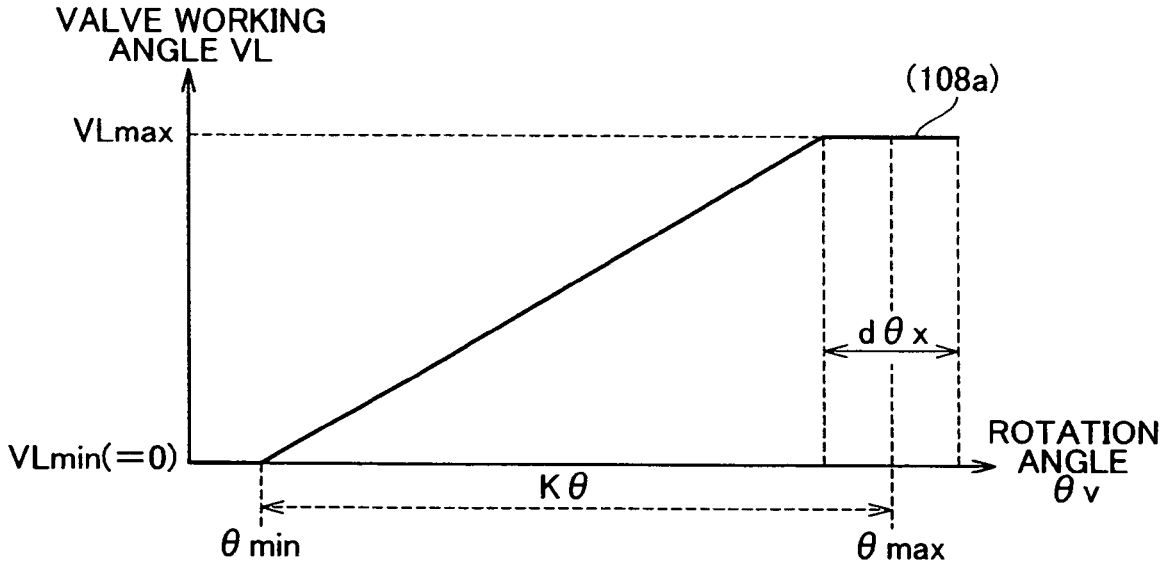
FIG. 10 is a graph showing the relationship between a rotation angle θv of a spiral cam and a valve working angle VL.

Due to the function of the above-mentioned spiral cam 104, as shown in FIG. 10, the relationship between the rotation angle θv of the cam shaft 104*a* and a valve working angle VL is realized. FIGS. 12A to 12D show the relationship between the spiral cam 104 and the control shaft 82 and the operations thereof, which set the relationship shown in FIG. 10.

The spiral cam 104 is housed in the inner space of the cam frame 110 provided at one end of the control shaft 82. The cam frame 110 contacts a spiral cam surface 108 of the spiral cam 104 at an inner surface 110*a* which is opposite of the side on which the control shaft 82 is attached. The inner surface 110*a* is a flat surface formed in a direction perpendicular to the axial direction of the control shaft 82. However, the inner surface 110*a* need not be a flat surface, and may be formed so as to protrude toward the spiral cam surface 108. A spring force is supplied to the cam frame 110 or the control shaft 82 in the direction shown in the figures such that the inner surface 110*a* contacts the spiral cam surface 108 at all times. When there is a certain degree of axial force which is supplied from the intake valve 2*a* to the control shaft 82 via the intermediary drive mechanism 60, it is not necessary to supply the spring force.

Figure 12A:
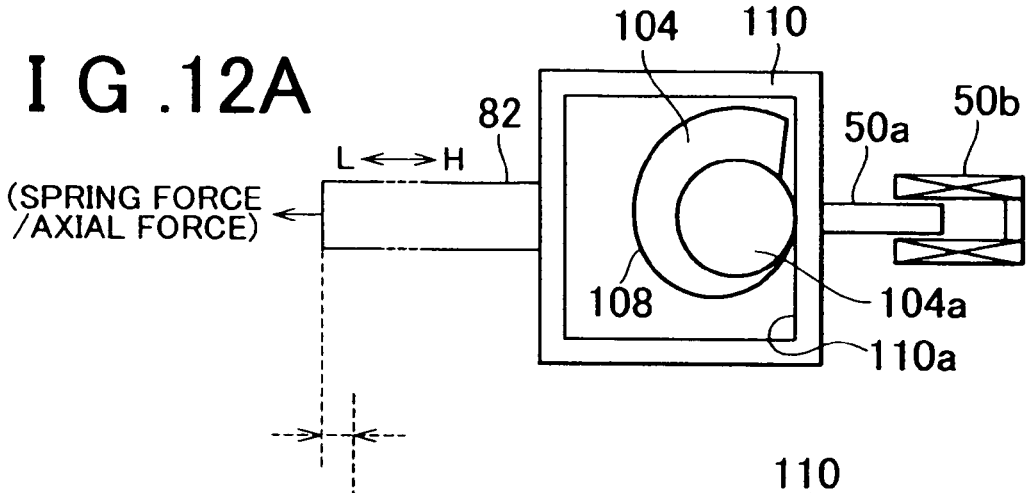
FIGS. 12A to 12D are views for describing adjustment of the valve lift amount performed by the shaft slide mechanism.

The position of the cam frame 110 is adjusted as described below. As shown in FIG. 12A, when the drive motor 102 (refer to FIG. 9) is operated until the spiral cam 104 reaches the limit position on the minimum valve working angle side, the spiral cam 104 contacts the inner surface 110*a* of the cam frame 110 at a portion of the spiral cam surface 108, which is the closet to the cam shaft 104, that is, at the lowest cam surface portion. At this time, the cam frame 110 moves in the L direction to the fullest extent, and in accordance with the movement of the cam frame 110, the control shaft 82 also moves in the L direction to the fullest extent by the spring force or the axial force. Thus, as shown in FIGS. 6A and 6B, the state in which the vale working angle is the minimum value is realized.

Figure 12B:
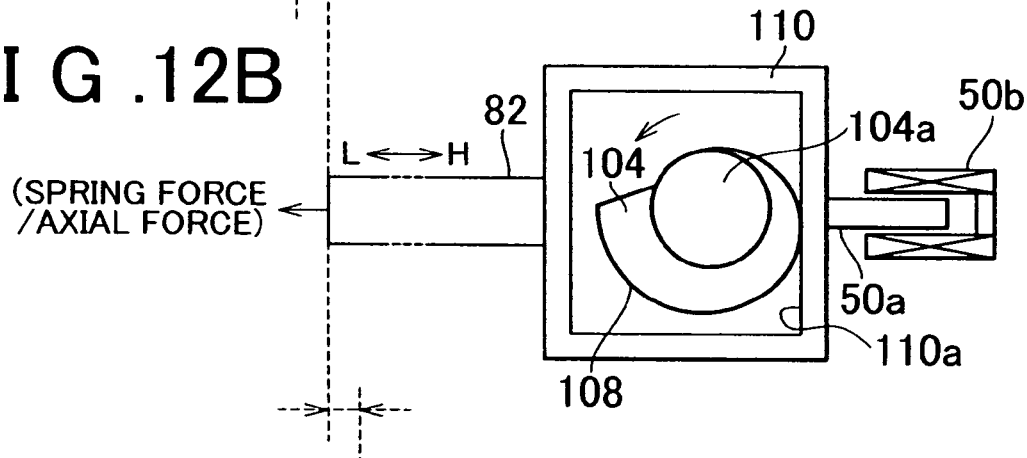

When the drive motor 102 is operated, and the spiral cam 104 is rotated in the direction shown by an arrow, as shown in FIG. 12B, the height of the spiral cam surface 108 gradually increases. Thus, the inner surface 110*a* of the cam frame 110 is pressed to the right in the figure, and the entire cam frame 110 moves in the H direction. In accordance with this movement, the control shaft 82 also moves in the H direction against the spring force or the axial force. Accordingly, the valve working angle is increased.

Figure 12C:
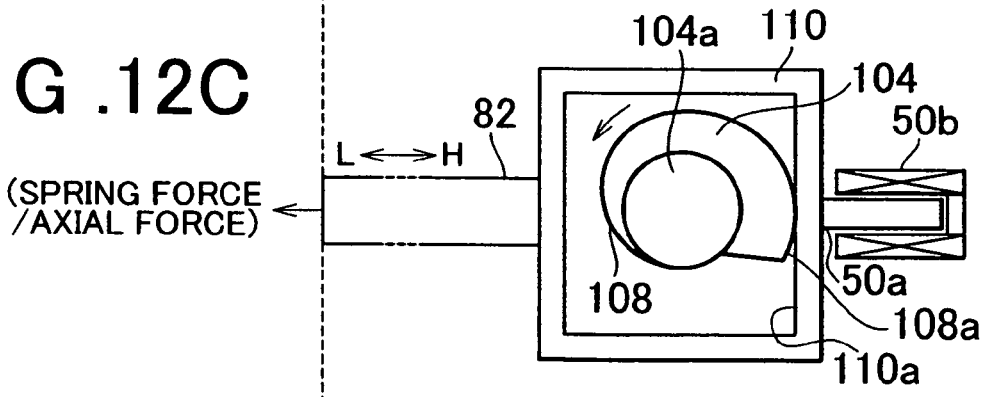

When the spiral cam 104 is further rotated in the direction shown by an arrow, as shown in FIG. 12C, the highest portion of the spiral cam surface 108 contacts the inner surface 110*a* of the cam frame 110. At this time, the cam frame 110 moves in the H direction to the fullest extent, and in accordance with the movement of the cam frame 110, the control shaft 82 moves to the H direction to the fullest extent against the spring force or the axial force. Thus, as shown in FIGS. 7A and 7B, the state in which the valve working angle is the maximum value is realized.

As shown in FIGS. 9 and 10, in the spiral cam surface 108, there is an invariable working angle region 108*a* in which the height of the cam surface does not change even when the rotation angle θv of the spiral cam 104 changes in the range of a width dθx on the maximum valve working angle side. The cam surface portion of the invariable working angle region 108*a* forms an arc-shaped surface which uses a rotation center P of the cam shaft 104*a* as the axis. Therefore, in the invariable working angle region 108*a*, the control shaft 82 does not move regardless of the rotational phase of the spiral cam 104, and the valve working angle of the intake valve 2*a* is maintained at the maximum value.

Figure 12D:
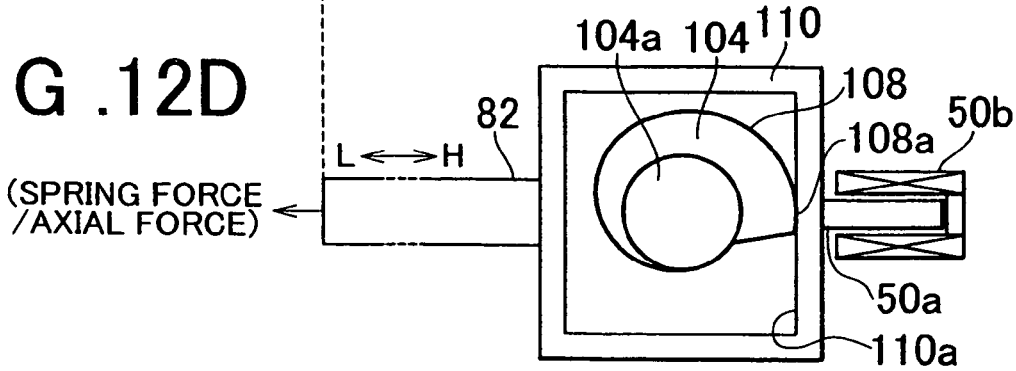

From the state shown in FIG. 12C to the state shown in FIG. 12D, the spiral cam 104 can be rotated. In the state shown in FIG. 12D, further rotation of the spiral cam 104 is prevented by the stopper provided inside the shaft slide mechanism 100. In the state shown in FIG. 12C, the cam surface portion which the inner surface 110*a* of the cam frame 110 contacts is the start position of the invariable working angle region 108*a*. Then, in the state shown in FIG. 12D, the inner surface 110*a* of the cam frame 110 still contacts the invariable working angle region 108*a*. Therefore, in the rotation shown in FIGS. 12C and 12D, the valve working angle of the intake valve 2*a* is maintained at the maximum value.

Figure 11:
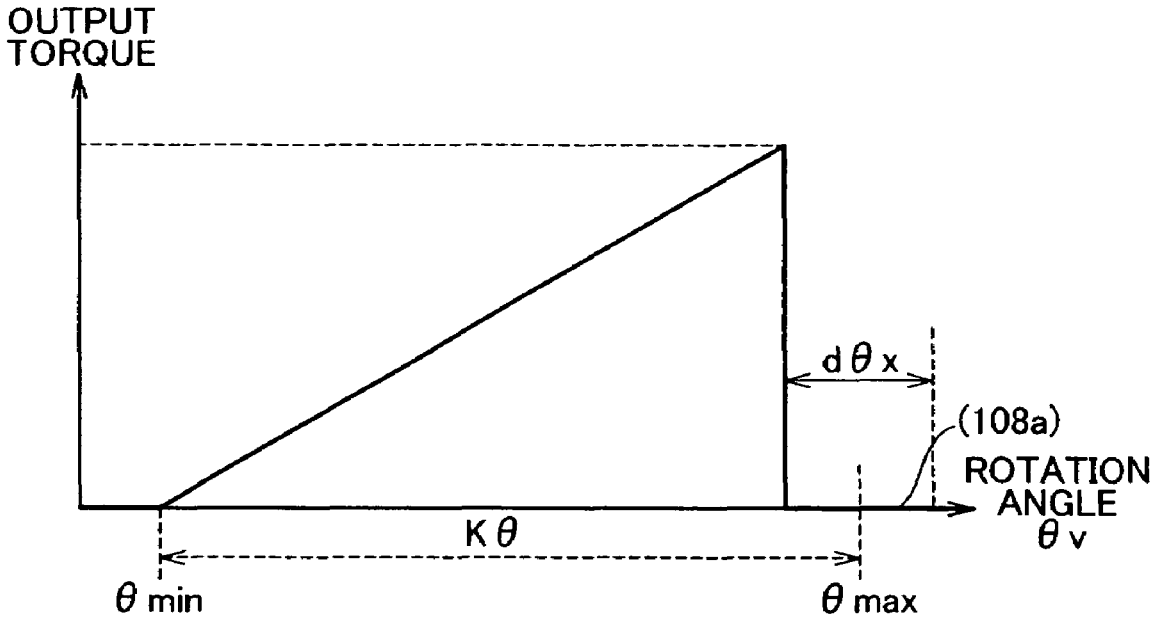
FIG. 11 is a graph showing the relationship between the rotation angle θv of a spiral cam and torque output from a drive motor required for maintaining the valve working angle.

The spiral cam surface 108 of the spiral cam 104 receives the spring force or the axial force from the inner surface 110*a* of the cam frame 110. When the spring force or the axial force are received by a portion of the spiral cam surface 108 other than the invariable working angle region 108*a*, a turning force is received in the direction opposite to the direction shown by an arrow in the figure. Therefore, in order to maintain the phase of the spiral cam 104, the drive motor 102 needs to continuously output toque which opposes the turning force. As shown in FIG. 11, the output torque for maintaining the phase of the spiral cam 104 increases as the rotation angle θv increases and the valve working angle increases. However, when the force is received by the invariable working angle region 108*a*, the turning force is not generated. Therefore, in the invariable working angle region 108*a*, the output from the drive motor 102 for maintaining the phase of the spiral cam 104 is "0".

The ECU 4 performs an initial state realizing process in which the drive motor 102 is controlled when the engine 2 is stopped such that the position at which the position of the spiral cam surface 108 contacts the inner surface 110*a* of the cam frame 110 is the invariable working angle region 108*a*. For example, after fuel injection from the fuel injection valve 16 is stopped when a request to stop the engine is made, and then the operation of the engine is stopped, the state shown in FIG. 12C is realized by using the slide sensor 50. Further, the state shown in FIG. 12D is realized by operating the drive motor 102 slowly, and the drive motor 102 is stopped. Whether the state shown in FIG. 12D is realized is determined based on an increase in an amount of electric current when the rotation is stopped by the stopper. When the change to the state shown in FIG. 12 is thus completed, an initial flag showing the initial state is set to ON and stored in nonvolatile memory.

Therefore, normally, the valve working angle of the intake valve 2*a* is the maximum value when the engine is started. Thus, the engine 2 is started in the initial state (the state in which the valve working angle is the maximum value).

The valve timing adjusting mechanism 58 shown in FIG. 1 includes an oil control valve (hereinafter, simply referred to as an "OCV"), and a hydraulic rotational mechanism. The ECU 4 performs duty control in which distribution of the hydraulic pressure to hydraulic chambers of the hydraulic rotational mechanism is controlled, and rotational phases of the intake cam shaft 64 and the crank shaft 6*a* are deviated from each other, thereby changing the valve timing. As shown in FIG. 8, the valve timing adjusting mechanism 58 controls the valve working angle and the valve timing by operating along with the valve working angle adjusting mechanism 56.

Next, valve working angle control process based on a value detected by the slide sensor 50, which is performed by the ECU 4, will be described.

Figure 13:
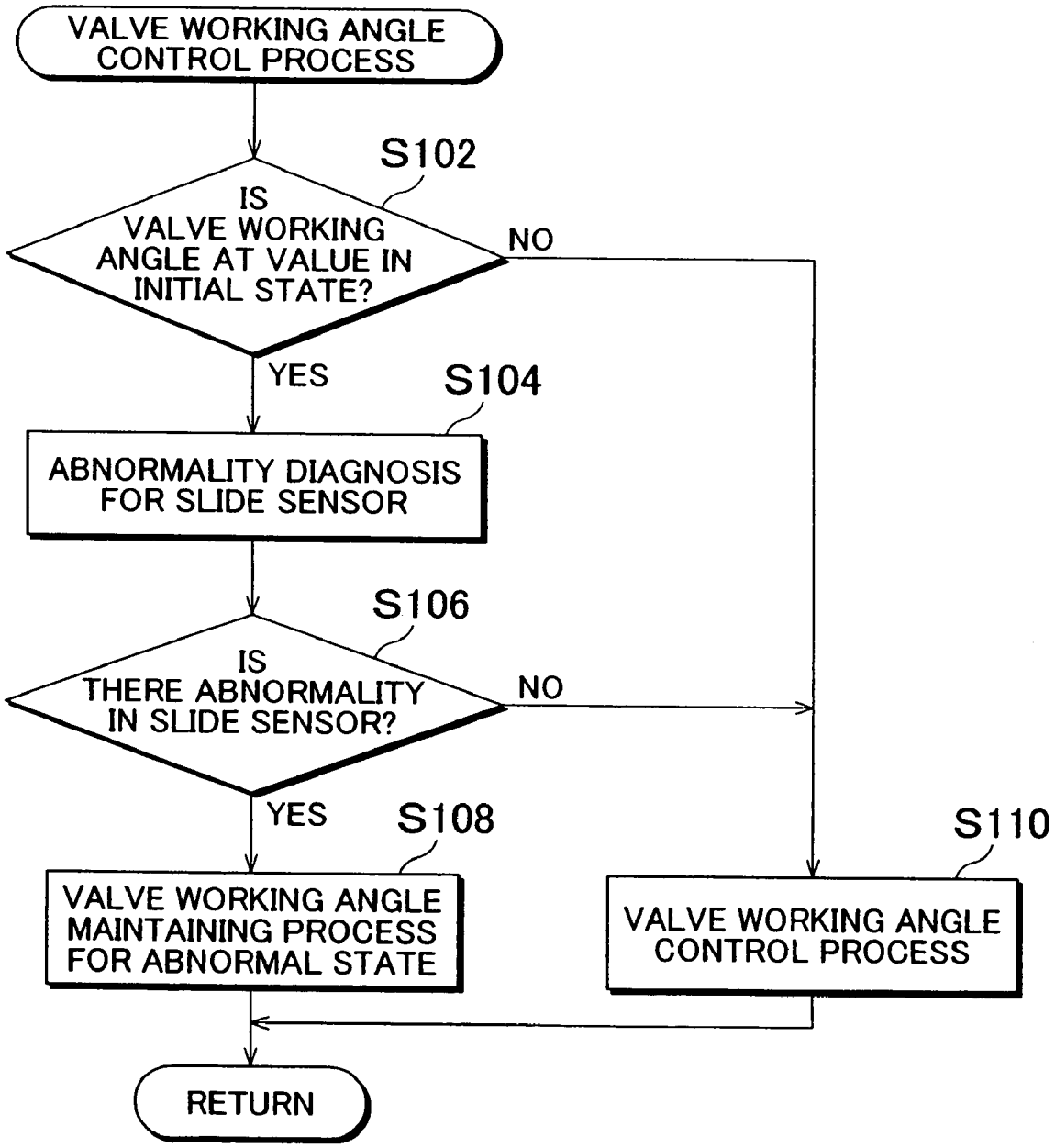
FIG. 13 is a flowchart for describing a valve working angle control process according to the first embodiment and a third embodiment.

FIG. 13 shows a flowchart of the working angle control process. The process is repeatedly performed at predetermined time intervals.

When the process is started, it is initially determined in step S102 whether the valve working angle is at the value in the initial state. In this case, as mentioned above, it is determined whether the initial flag showing the initial state stored in the nonvolatile memory is ON. In the case where the engine is started, when the initial flag is ON ("YES" in step S102), it is determined in step S104 whether an abnormality has occurred in the slide sensor 50. The slide sensor 50 performs measurement using two coils provided therein for self abnormality diagnosis. When the difference between the values output from these two coils becomes large, the ECU 4 can performs a diagnostic process on the assumption that there is an abnormality. In the embodiment, when the valve working angle is at the value in the initial state, it is reliably determined whether there is an abnormality in the slide sensor 50.

Next, it is determined in step S106 whether a determination that there is an abnormality in the slide sensor 50 is made in the abnormality diagnostic process in step S104. When it is determined that there is no abnormality ("NO" in step S106), a valve working angle variable control process for the normal operation time is performed in step S110. Namely, a load factor (a ratio of the load to the maximum engine load) is calculated based on the operating state of the engine 2, in this case, according to a map which is set in advance by an experiment based on the accelerator pedal operation amount ACCP and the engine rotational speed NE. Then, a target valve working angle is set based on the load factor. Then, a process for controlling the drive motor 102 is performed based on the value detected by the slide sensor 50 such that the valve working angle becomes the target valve working angle.

In the case of the cold start, in the valve working angle control process in step S110, priority is given to a process for maintaining the valve working angle at the value in the initial state until warm-up is completed. Therefore, until warm-up is completed, even when it is determined that there is no abnormality in the slide sensor 50, an affirmative determination is made in step S102, and the abnormality diagnosis for the slide sensor 50 (step S104) is continued.

For example, when an abnormality has occurred in the slide sensor 50 while the engine 2 is stopped ("YES" in step S106), next, a valve working angle maintaining process for the abnormal state is performed in step S108. The valve working angle maintaining process is performed for maintaining the state where the valve working angle is a value in the initial state. Namely, the valve working angle maintaining process is a process for maintaining the valve working angle such that the valve working angle is not changed from a value in the initial state, without performing the valve working angle variable control process for the normal operation time in step S110.

In the initial state, the cam frame 110 contacts the invariable working angle region 108. Therefore, rotational torque is not generated in the spiral cam 104. Accordingly, the valve working angle maintaining process may be performed just by stopping electric power supply to the drive motor 102 such that the driving force is not generated. However, there is a possibility that the position at which the cam frame 110 contacts the spiral cam surface 108 deviates from the invariable working angle region 108*a* due to vibration caused by the operation of the engine during the refuge running. Accordingly, in the embodiment, in consideration of this vibration, the torque, which is used for increasing the valve working angle, is supplied to the spiral cam 104 by the drive motor 102, in the state where the output is decreased as compared to the normal driving state. By continuing the drive control for the drive motor 102, even when the spiral cam 104 attempts to rotate, the rotation is prevented by the stopper provided in the shaft slide mechanism 100, and the state in FIG. 12D is maintained.

When it is determined that a failure has occurred in the slide sensor 50 in the variable valve mechanism 54, the driver is notified of the failure by an alarm lamp provided on a dashboard. However, the valve working angle of the intake valve 2*a* is at the value in the initial state. Accordingly, the engine 2 can be started, and the refuge running can be performed by controlling the throttle valve 26 and controlling the amount of fuel injected from the fuel injection valve 16. Therefore, the driver can drive the vehicle to a service garage.

Since the valve working angle maintaining process in step S108 is continued, an affirmative determination is made in step S102 even after the engine is started, and the abnormality diagnosis for the slide sensor 50 in step S104 is repeatedly performed. When the determination that there is an abnormality is repeatedly made ("YES" in step S106), the valve working angle maintaining process in step S108 is continued.

When the slide sensor 50 returns to the normal state, a negative determination is made in step S106 ("NO" in step S106), and the valve working angle variable control process for the normal operation time is performed in step S110. Thus, when the valve working angle deviates from the value in the initial state, a negative determination is made in step S102 ("NO" in step S102), afterwhich the valve working angle variable control process for the normal operation time in step S110 is continued.

Also, when a failure has occurred in the valve timing adjusting mechanism 58 while the engine is operated, the ECU may set the valve working angle to the initial position in order to prevent the situation in which the valve overlap state becomes abnormal and the engine cannot be operated stably. At this time as well, the initial flag is set to ON.

Even in such a case, by making an affirmative determination in step S102, the abnormality diagnosis for the slide sensor 50 is performed. Therefore, when it is determined that a failure has occurred in the valve timing adjusting mechanism 58 and further it is determined there is an abnormality in the slide sensor 50, even if the valve timing adjusting mechanism 58 returns to the normal state, the valve working angle maintaining process in step S108 is continued and the valve working angle is maintained at the value in the initial state, as long as the abnormality in the slide sensor 50 exits.

Figure 14A:
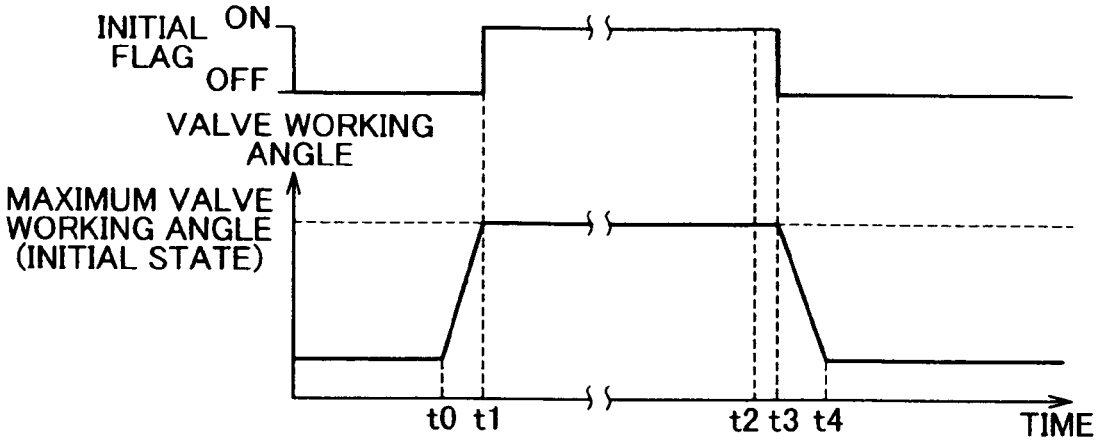
FIGS. 14A to 14C show a timing chart indicating an example of a process according to the first embodiment.
Figure 14B:
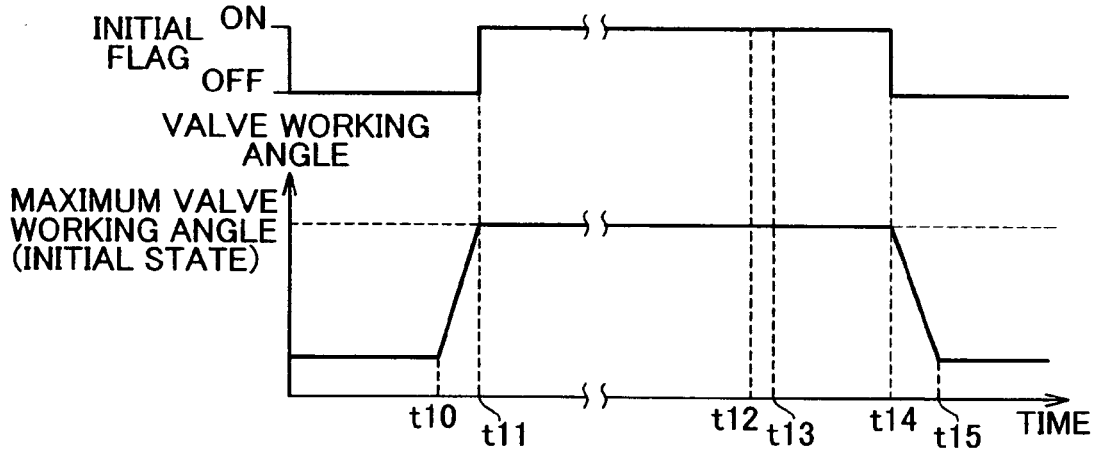
Figure 14C:
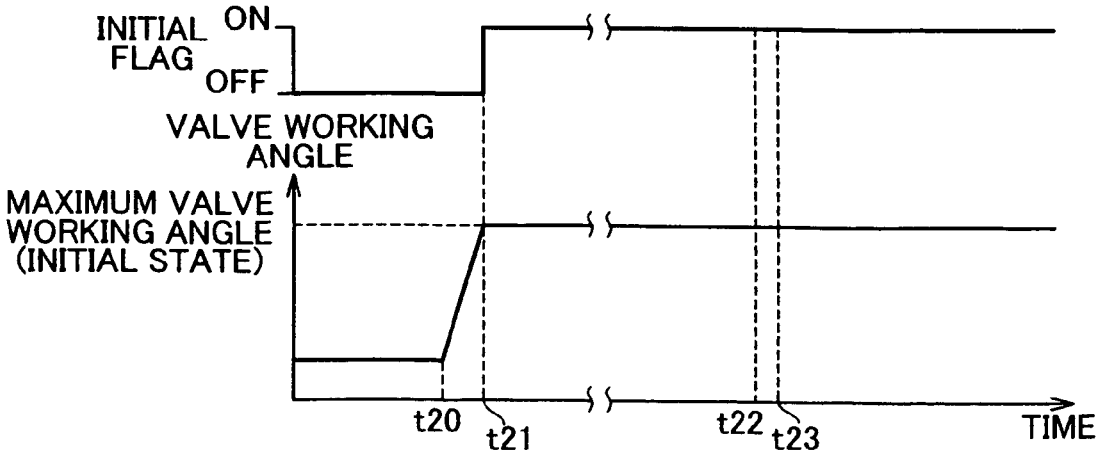

Timing charts in FIGS. 14A to 14C show examples of the control according to the embodiment. In the example shown in FIG. 14A, after the engine is stopped at time to, the spiral cam 104 is rotated by the drive motor 102, and the valve working angle is made the value in the initial state at time t1. After this, when an ignition is turned ON at time t2 in order to start the engine, the abnormality diagnosis for the slide sensor 50 is performed from time t2 to time t3, while maintaining the valve working angle at the value in the initial state. From time t2 to time t3, engine start is initiated by cranking. When it is determined at time t3 that there is no abnormality, the process proceeds to the valve working angle variable control process for the normal operation time from time t3 to time t4, and the valve working angle variable control process for the normal operation time is performed from time t4.

FIG. 14B shows an example of the cold start. The state from time t10 to time t13 is the same as the state from time t0 to time t3 in FIG. 14A, and it is determined that there is no abnormality in the slide sensor 50. However, during warm-up, the valve working angle is maintained at the value in the initial state from time t13 to time t14. When warm-up is completed at time t14, the process proceeds to the valve working angle variable control process for the normal operation time from time t14 to time t15, and the valve working angle variable control process for the normal operation time is performed from time t15.

FIG. 14C shows an example of the case in which it is determined that there is an abnormality in the slide sensor 50. The state from time t20 to time t23 is the same as the state from time t0 to time t3 in the example shown in FIG. 14A, and as the result of the abnormality diagnosis performed from time t22 to time t23, it is determined that there is an abnormality in the slide sensor 50. Therefore, after time t23, the valve working angle is maintained at the value in the initial state. It is thus possible to start the engine and perform refuge running.

In the above-mentioned structure, steps S102 and S104 of the valve working angle control process in FIG. 13 can be regarded as the process performed by the failure diagnostic means. Steps S106 and S108 of the valve working angle control process can be regarded as the process performed by the valve state maintaining means. Also, the initial state realizing process, which is performed by the ECU 4 when the engine is stopped in order to realize the initial state of the valve working angle when the engine is started, can be regarded as the process performed by the start time valve characteristic value setting means.

According to the first embodiment described so far, the following effects can be obtained.

(A) The abnormality diagnosis for the slide sensor 50 in step S104 is performed when the valve working angle is at the value in the initial state. The initial state is set to the state in which the valve working angle is the maximum value. The maximum valve working angle corresponds to the refuge running performable region, and is the valve working angle at which the engine 2 can be started and the refuge running can be performed.

Accordingly, even when it is difficult to adjust the valve working angle using rotation of the spiral cam 104 due to a failure in the slide sensor 50, the refuge running can be performed only by maintaining the present initial state by the maintaining control in step S108.

It is thus possible to increase reliability of the refuge running in the case where a failure has occurred in the variable valve mechanism 54.

(B) In the embodiment, the spiral cam 104 formed in the above-mentioned manner is used. Therefore, even when the state, where the cam frame 110 contacts the invariable working angle region 108*a*, is maintained, torque due to a pressure from the cam frame 110 is not generated in the spiral cam 104. Accordingly, it is possible to stop electric power supply to the drive motor 102 during the valve working angle maintaining process. When such control is performed, it is possible to maintain the valve characteristic value at which the refuge running can be reliably performed without consuming the driving energy after a determination that a failure has occurred is made.

Also, in the example described in the embodiment, the drive motor 102 is operated such that the valve working angle is increased in order to prevent the valve working angle from deviating from the position in the initial state due to vibration caused by the operation of the engine. In this case as well, the amount of driving force output from the drive motor 102 can be smaller than that in the normal state. Accordingly, only a small amount of energy for driving is required.

In addition, since the amount of driving force output from the drive motor 102 is small, the valve working angle adjusting mechanism 56 is prevented from moving the control shaft 82 at a high speed. Accordingly, even when the control shaft 82 is moved to the dead end, an internal member of the variable valve mechanism 54 and the control shaft 82 are prevented from colliding with the stopper or the like at a high speed. It is therefore possible to increase durability of the variable valve mechanism 54, and prevent a sense of discomfort due to an impulsive sound, which is felt by a driver.

(C) Particularly, since the valve working angle is made the value in the initial state by the initial state realizing process when the engine is stopped, the valve working angle is at the value in the initial state at least when the engine is started. Therefore, it is possible to immediately perform the abnormality diagnosis for the slide sensor 50 when the engine is started. In addition, when it is determined that a failure has occurred, it is possible to immediately start the engine only by performing the maintaining control and start the refuge running.

It is thus possible to further increase reliability of the refuge running in the case where a failure has occurred in the variable valve mechanism 54.

Hereafter, a second embodiment of the invention will be described in detail. In the embodiment, when a failure has occurred in the drive motor 102 which serves as the actuator, the valve working angle maintaining process is performed. Accordingly, instead of the valve working angle control process shown in FIG. 13, the valve working angle control process shown in FIG. 15 and the failure diagnostic process for the drive motor shown in FIG. 16 are performed. The other structure is the same as that in the first embodiment. Therefore, description will be made with reference to FIGS. 1 to 12.

The valve working angle control process shown in FIG. 15 will be described. The process is repeatedly performed at predetermined time intervals.

When the process is started, it is initially determined in step S202 whether the valve working angle is at the value in the initial state. This is the same as step S102 of the valve working angle control process in FIG. 13. Namely, when the initial flag is ON ("YES" in step S202), it is determined in step S204 whether the failure diagnosis for the drive motor 102 has been unperformed at this start time of the engine.

When it is determined that the failure diagnosis for the drive motor 102 has been unperformed ("YES" in step S204), in step S206, the failure diagnostic process for the drive motor 102 is set to be performed. The failure diagnostic process for the drive motor is shown in the flowchart in FIG. 16, and is repeatedly performed at predetermined time intervals.

Next, the diagnostic process for the drive motor will be described with reference to FIG. 16. It is initially determined in step S252 whether it is determined that the result of the failure diagnosis for the drive motor 102 concerning the operation for increasing the valve working angle shows the normal state. At the start time of the failure diagnosis, no result can be obtained yet ("NO" in step S252). Then, the failure diagnosis for the drive motor 102 concerning the operation for increasing the valve working angle is performed in step S254. In the failure diagnosis for the drive motor 102 concerning the operation for increasing the valve working angle, first, the process for rotating the spiral cam 104 such that the valve working angle is increased is performed by supplying electric power, whose amount is smaller than that at the normal control time, to the dive motor 102 such that the drive motor 102 is slightly driven. The slightly driving process is performed when the drive motor 102 is normally driven and the position, at which the cam frame 110 contacts the spiral cam surface 108, moves in the invariable operation angle region 108*a*. Also, the slightly driving process is performed by the time at which the movement is estimated to be prevented by the stopper provided in the valve working angle adjusting mechanism 56. During this slightly driving process, the ECU 4 measures the amount of electric current supplied to the drive motor 102.

When the movement is prevented by the stopper while the drive motor 102 is driven normally and the drive motor 102 is forcibly stopped, the amount of electric current supplied to the drive motor 102 is increased. Therefore, the ECU 4 determines whether the increase in the amount of electric current has occurred by the time at which the movement is estimated to be prevented by the stopper. If the corresponding increase has occurred, it is determined that there is no failure in the drive motor 102 in the operation for increasing the valve working angle. If the corresponding increase has not occurred, it is determined that a failure has occurred in the drive motor 102 in the operation for increasing the valve working angle.

After the failure diagnostic process for the drive motor 102 concerning the operation for increasing the valve working angle is started in step S254, it is then determined in step S256 whether the failure diagnosis for the drive motor 102 concerning the operation for increasing the valve working angle has been completed. When it is determined that the failure diagnosis for the drive motor 102 concerning the operation for increasing the valve working angle has not been completed ("NO" in step S256), the process ends.

Figure 15:
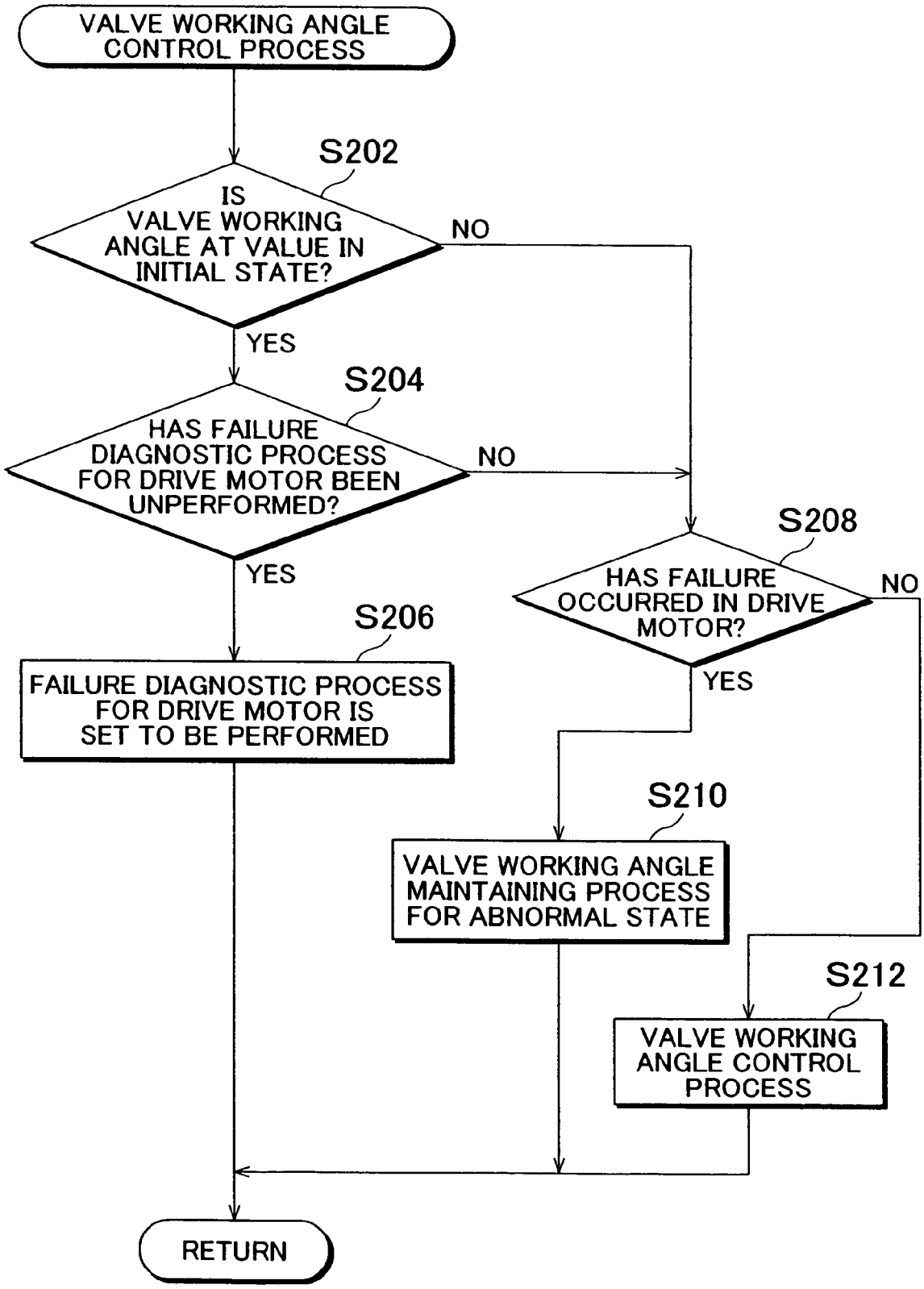
FIG. 15 is a flowchart for describing a valve working angle control process according to the second embodiment and a fourth embodiment.
Figure 16:
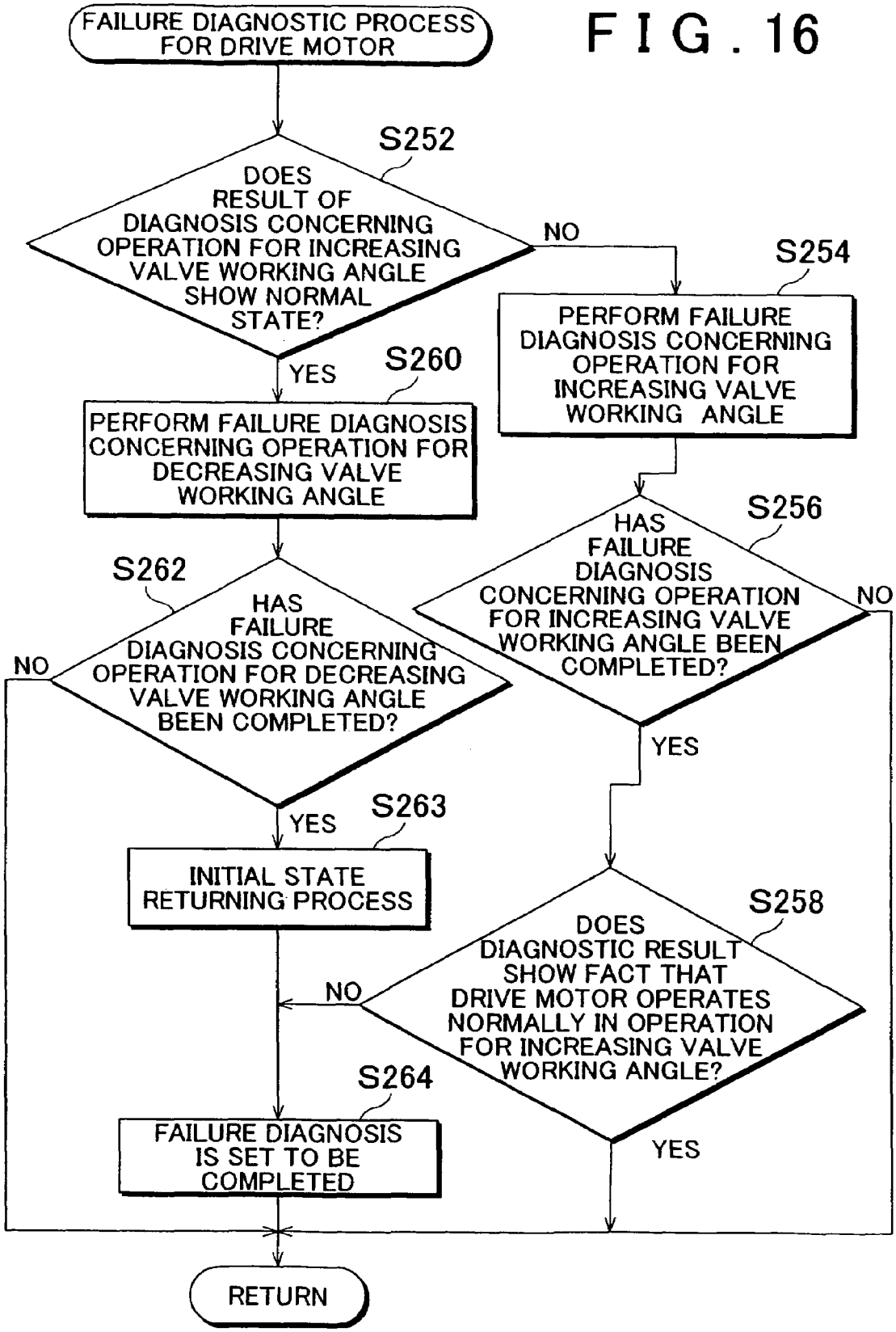
FIG. 16 is a flowchart showing a failure diagnostic process for the drive motor, which is performed in the valve working angle control process according to the second embodiment and the fourth embodiment.

In the next control process and the following control processes, in the valve working angle control process in FIG. 15, an affirmative determination is made in each of steps S202 and S204 and the process in step S206 is repeatedly performed until the diagnosis in the failure diagnostic process for the drive motor is completed. In the failure diagnostic process for the drive motor in FIG. 16, a negative determination is made in each of steps S252 and S26, and the process in step S254 is repeatedly performed.

In the failure diagnostic process for the drive motor in FIG. 16, when the result of the failure diagnosis for the drive motor 102 concerning the operation for increasing the valve working angle is obtained ("YES" in step S256), it is determined in step S258 whether the diagnostic result shows the normal state concerning the operation for increasing the valve working angle.

When the diagnostic result shows the normal state ("YES" in step S258), the process ends, and an affirmative determination is made in step S252 in the next control process. Then, the failure diagnosis for the drive motor 102 concerning the operation for decreasing the valve working angle is performed in step S260. In the failure diagnosis for the drive motor 102 concerning the operation for decreasing the valve working angle, first, the process for rotating the spiral cam 104 such that the valve working angle is decreased is performed by supplying electric power, whose amount is smaller than that for the normal control time, to the drive motor 102 such that the drive motor 102 is slightly driven. In this case, the slightly driving process is performed by the estimated time at which the drive motor 102 is actually driven normally, and the position, at which the cam frame 110 contacts the spiral cam surface 108, is moved from the invariable working angle region 108*a* and reaches the cam surface portion which is actually tilted in the spiral form and the movement is reflected in the value detected by the slide sensor 50.

When the drive motor 102 is thus normally driven, the value detected by the slide sensor 50 shows a decrease in the valve working angle. Therefore, the ECU 4 determines whether a change in the detected value occurs by the estimated time. When the change has occurred, it is determined that there is no failure in the drive motor 102 in the operation for decreasing the valve working angle. When the change has not occurred, it is determined that a failure has occurred in the drive motor 102 in the operation for decreasing the valve working angle.

After the failure diagnostic process for the drive motor 102 concerning the operation for decreasing the valve working angle is started in step S260, it is determined in step S262 whether the failure diagnosis for the drive motor 102 concerning the operation for decreasing the valve working angle has been completed. When it is determined that the failure diagnosis for the valve working angle decease side has not been completed ("NO" in step S262), the process ends.

In the next process and the following processes, in the valve working angle control process shown in FIG. 15, an affirmative determination is made in each of steps S202 and S204 and the process in step S206 is repeatedly performed, until the diagnosis in the failure diagnostic process for the drive motor is completed. In the failure diagnostic process for the drive motor in FIG. 16, since an affirmative determination is made in step S252 and a negative determination is made in step S262, the process in step S260 is repeatedly performed.

In the failure diagnostic process for the drive motor shown in FIG. 16, when the result of the failure diagnosis for drive motor 102 concerning the operation for decreasing the valve working angle is obtained ("YES" in step S262), an initial state returning process is performed in step S263 based on the value detected by the slide sensor 50.

The initial state returning process is performed for reliably returning the valve working angle to the value in the initial state. When it is determined that the drive motor 102 is driven normally in the failure diagnostic process for the drive motor 102 concerning the operation for decreasing the valve working angle is performed immediately before the initial state returning process, the spiral cam surface 108 contacts the cam frame 110 at the portion which actually has a spiral shape. Therefore, if this state is left as it is, in the operation of the engine during the engine start or when a failure has occurred in the valve timing adjusting mechanism 58, there is a possibility that the valve working angle is gradually decreased, and it becomes difficult to start the engine and perform the refuge running. In order to prevent such a situation, the process is performed for driving the drive motor 102 such that the valve working angle is increased, and returning the valve working angle to the value in the initial state. When a failure has occurred in the operation for decreasing the valve working angle, the position at which the spiral cam surface 108 contacts the cam frame 110 does not deviate from the invariable working angle region 108*a*. Therefore, the initial state returning process in step S263 need not be performed. However, in some cases, the position, at which the spiral cam surface 108 contacts the cam frame 110, is about to deviate from the invariable working angle region 108*a* even if a decrease in the valve working angle is not detected by the slide sensor 50. Accordingly, the initial state returning process in step S263 may be reliably performed in order to maintain the valve working angle with reliability.

When starting of the engine 2 is completed during the failure diagnostic process and it is not determined that a failure has occurred, the process proceeds to the valve working angle control process for the normal state. Therefore, in this case, the initial state returning process in step S263 need not be performed.

After step S263 is performed, the failure diagnosis is set to be completed in step S264, afterwhich the process ends. Even when it is determined in step S258 that there is an abnormality in the operation for increasing the valve working angle ("NO" in step S258), the failure diagnosis is set to be completed in step S264.

When the result of diagnosis for the drive motor 102 is obtained, in the valve working angle control process in FIG. 15, it is determined that the failure detection process has been performed ("NO" in step S204), next, it is determined in step S208 whether the result of the diagnosis shows that a failure has occurred in the drive motor 102.

When it is determined that a failure has occurred in the drive motor 102, that is, a failure has occurred at one of the valve working angle increase time and the valve working angle decrease time ("YES" in step S208), next, the valve working angle maintaining process for the abnormal state is performed in step S210. The valve working angle maintaining process is the same as step S108 of the valve working angle control process in FIG. 13. The valve working angle has already been at the value in the initial state. Therefore, as mentioned above, the drive motor 102 may be slightly driven, or electric power supply to the drive motor 102 may be stopped.

When a failure has occurred, in the following control processes, an affirmative determination is made in step S202, a negative determination is made in step S204, and an affirmative determination is made in step S208. Then, the process in step S210 is continued.

When it is determined that there is no failure in the drive motor 102 ("NO" in step S208), the valve working angle variable control process for the normal operation time is performed in step S212. The valve working angle variable control process for the normal operation time is the same as step S110 of the valve working angle control process in FIG. 13.

When there is no failure, in the following valve working angle control process in FIG. 15, during transition state where the valve working angle is at the value in the initial state, an affirmative determination is made in step S202, a negative determination is made in step S204, and a negative determination is made in step S208. Then, step S212 is performed. After the valve working angle deviates from the value in the initial state, a negative determination is made in step S202, and a negative determination is made in step S208. Then, the process in step S212 is continued.

When a failure has occurred in the valve timing adjusting mechanism 58, as mentioned above, the ECU 4 may set the valve working angle to the initial position, and initial flag to ON. Even in such a case, an affirmative determination is made in step S202, and therefore the process which is the same as that at the engine start time is performed.

Figure 17A:
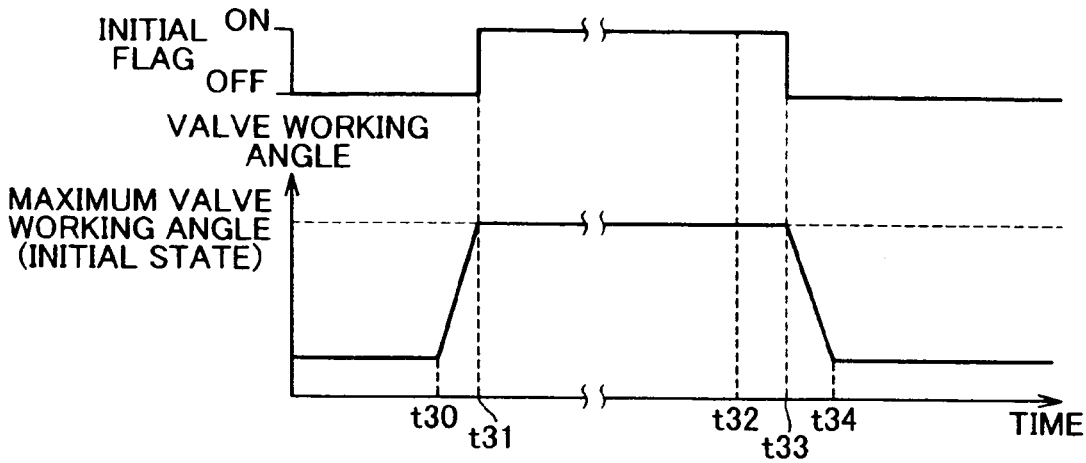
FIGS. 17A to 17C show a timing chart indicating an example of a process according to the second embodiment.
Figure 17B:
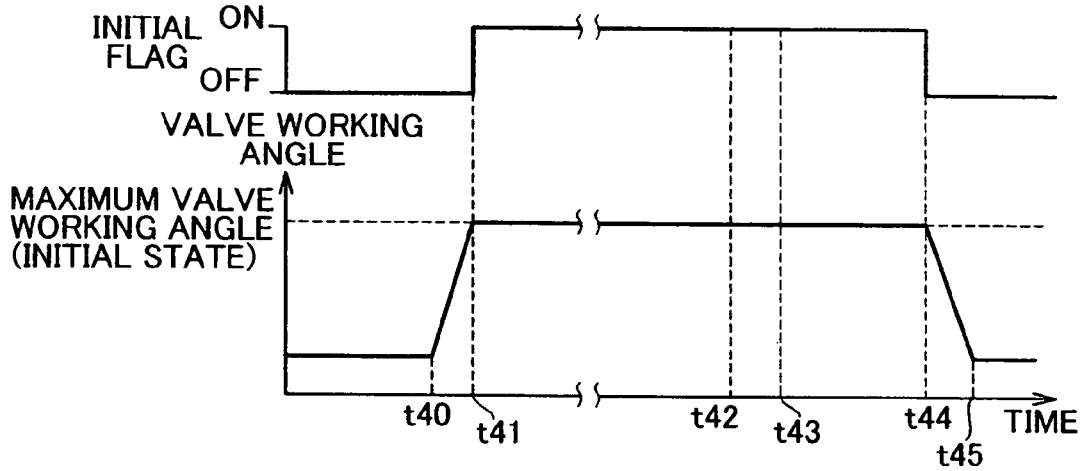
Figure 17C:
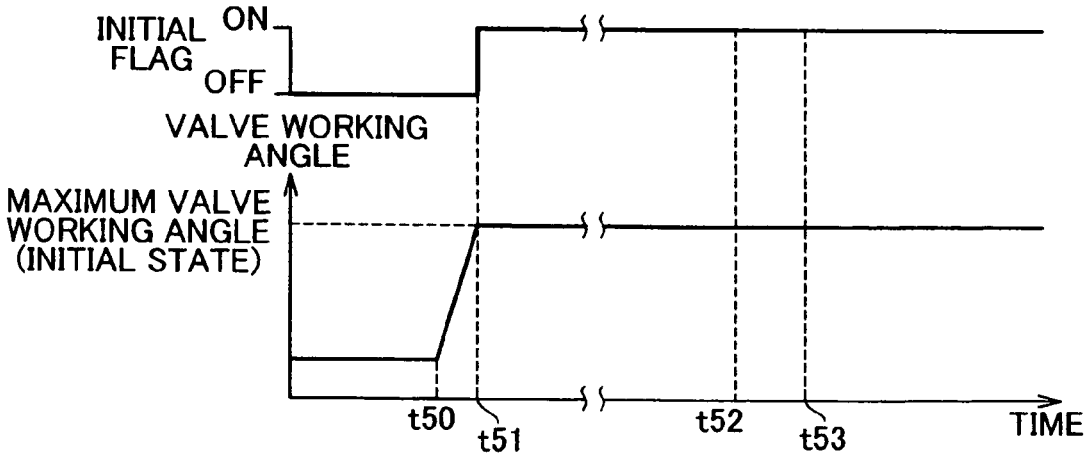

The timing charts in FIGS. 17A to 17C show examples of the control in the embodiment. FIG. 17A shows an example of the case where there is no failure in the drive motor 102. FIG. 17B shows an example of the case where there is no failure in the drive motor 102 at the cold start time. FIG. 17C shows an example of the case where it is determined that a failure has occurred in the drive motor 102 as the result of the failure diagnosis. The flow of the process is the same as that shown in FIGS. 14A to 14C except for the fact that there are the failure diagnostic periods (time t32 to time t33, time t42 to time t43, and time t52 to time t53) for the drive motor 102 instead of the failure diagnostic periods for the slide sensor 50, and the failure diagnostic periods for the drive motor 102 are longer than those for the slide sensor 50.

In the above-mentioned structure, steps S202 and S206 of the valve working angle control process in FIG. 15 and the failure diagnostic process for the drive motor in FIG. 16 can be regarded as the process performed by the failure diagnostic means. Steps S208 and S210 can be regarded as the process performed by the valve state maintaining means.

According to the second embodiment described so far, the following effects can be also obtained.

(A) The effects in the descriptions (A) to (C) in the first embodiment can be also obtained in the case where a failure has occurred in the drive motor 102.

(B) Driving of the drive motor 102 for the failure diagnosis is performed at an output at a level lower than the output of a driving force in the normal state. Therefore, even when a collision with the stopper occurs, the amount of movement at the time of collision is small. It is therefore possible to increase durability of the valve working angle adjusting mechanism 56, and prevent a sense of discomfort due to an impulsive sound, which is felt by a driver.

(C) In the failure diagnosis, first, the drive motor 102 is driven such that the valve working angle is increased. When a failure has occurred in the drive motor 102 in the operation for increasing the valve working angle, the maintaining control is immediately performed. Then, the valve working angle is maintained at the value in the initial state. It is therefore possible to start the engine and perform refuge running.

Only after it is determined that there is no failure in the drive motor 102 in the operation for increasing the valve working angle, the drive motor 102 is driven such that the valve working angle is decreased. Then, it is determined whether a failure has occurred in the drive motor 102 in the operation for decreasing the valve working angle. Even when it is determined that a failure has occurred, the drive motor 102 can be driven such that the valve working angle is increased. Therefore, the valve working angle can be immediately increased to the value in the initial state or the value higher than the value in initial state.

It is therefore possible to increase reliability of the refuge running in the case where a failure has occurred in the variable valve mechanism 54.

Figure 18:
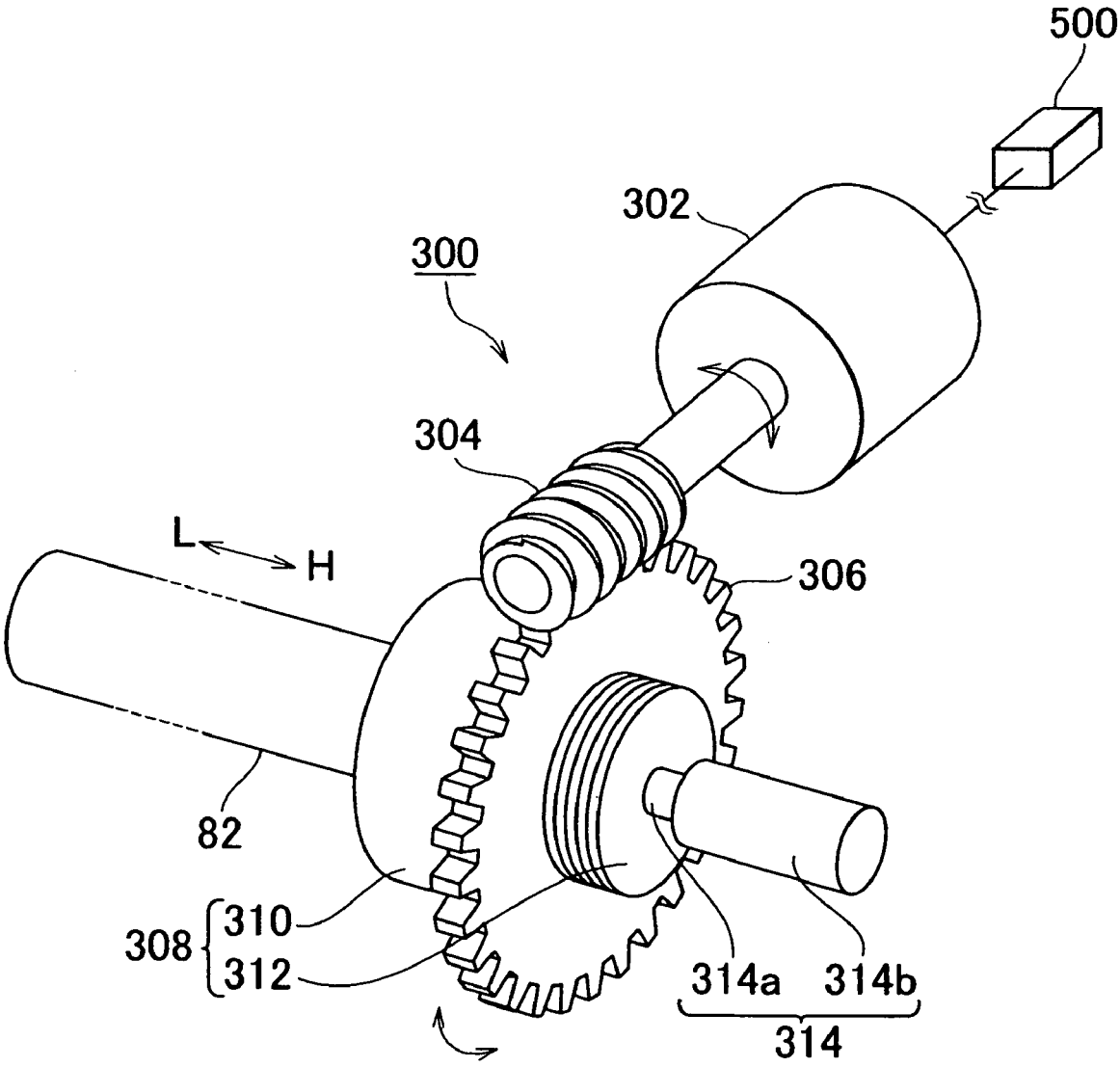
FIG. 18 is a view showing a structure of the shaft slide mechanism using a worm gear, which is used in the third embodiment and the fourth embodiment.

Hereafter, a third embodiment of the invention will be described in detail. In the embodiment, as shown in FIG. 18, a shaft slide mechanism 300 provided with a worm gear is used instead of the shaft slide mechanism 100 in the second embodiment, and whether a failure has occurred in a slide sensor 314 is determined. The process is performed using the same flow as the valve working angle control process shown in FIG. 13. However, the contents of the process are different, as described later, since the shaft slide mechanism 300 provided with the worm gear is used. The other elements are the same as those in the first embodiment. Therefore, description will be made with reference to FIGS. 1 to 8.

First, the shaft slide mechanism 300 be described. The shaft slide mechanism 300 includes a worm gear 304 which is rotated by a drive motor 302 using an electric power supplied from the battery 500; and a driven gear 306 which is rotated by the worm gear 304. The driven gear 306 is formed integrally with a female screw portion 310 of a reducer 308. A male screw portion 312 of the reducer 308, which is screwed into the female screw portion 310, is fixed to one end of the control shaft 82. Thus, when the drive motor 302 is operated, the female screw portion 310 is rotated via the worm gear 304 and the driven gear 306. As a result, the male screw portion 312 of the reducer 308 is moved in the axial direction along with the control shaft 82. It is thus possible to adjust the valve working angle of the intake valve 2*a*.

The position of the control shaft 82 in the axial direction is detected by the slide sensor 314. The slide sensor 314 includes a detection rod 314*a* which is fixed to the male screw portion 312 of the reducer 308; and a detection coil 314*b* which is fixed on the cylinder head 10 side. The ECU 4 can measure a slide amount of the control shaft 82 according to a signal from the detection coil 314*b* into which the end of the detection rod 314*a* is inserted. Also, the ECU 4 can detect the valve working angle of the intake valve 2*a*.

Figure 19:
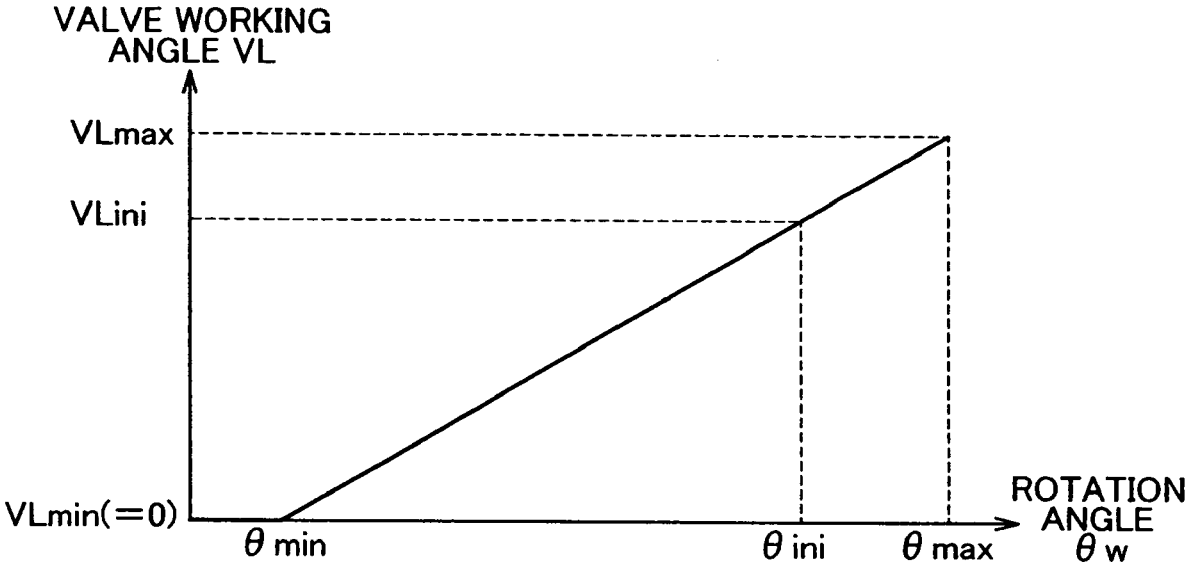
FIG. 19 is a graph showing the relationship between a rotation angle θw of a driven gear that is rotated by the worm gear, and a valve working angle VL.

FIG. 19 shows the relationship between a rotation angle θw of the worm gear 304 and a valve working angle VL when the shaft slide mechanism 300 is used. In FIG. 19, the valve working angle monotonously changes according to a change in the rotation angle θw, and there is no invariable working angle region shown in FIG. 10 in the first embodiment.

Figure 20:
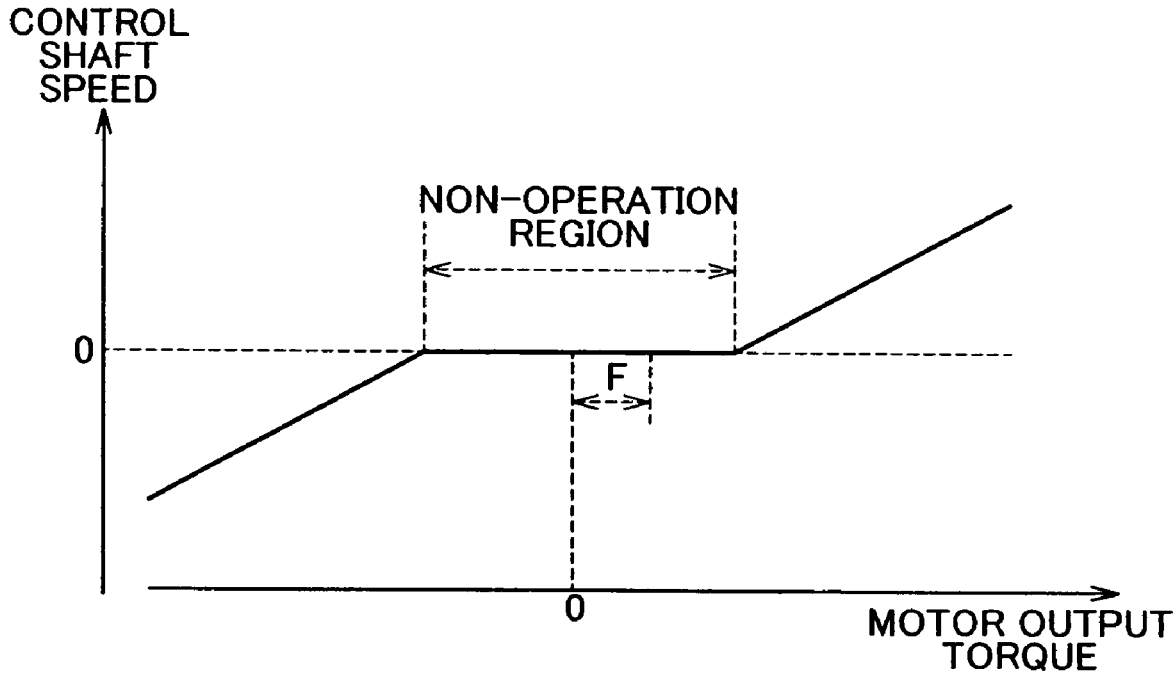
FIG. 20 is a graph showing the relationship between torque output from the motor in the shaft slide mechanism using the worm gear, and a speed of a control shaft.

FIG. 20 show the relationship between torque output from the drive motor 302 and a movement speed of the control shaft 82. Since the worm gear 304 is used in the shaft slide mechanism 300, there exits a non-operation region in which the control shaft 82 cannot be moved due to friction before and after the output torque becomes "0", even when torque is output from the drive motor 302. Therefore, even when there is no invariable working angle region, by making the toque output from the drive motor 302 "0", the valve working angle can be maintained. In addition, the valve working angle can be maintained at an arbitrary value.

The ECU 4 performs the valve working angle control process using the above-mentioned function of the shaft slide mechanism 300. Description will be made with reference to FIG. 13, since the flow of the process is the same as that in FIG. 13 although the contents of the process are different from those in FIG. 13.

When the process is started, it is initially determined in step S102 whether the valve working angle is at the value in the initial state. When the engine is being started, it is determined whether the initial flag showing the initial state stored in the non-volatile memory is ON.

In the embodiment, as shown in FIG. 19, the value in initial state is set to an initial state value VLini which is slightly smaller than the maximum valve working angle VLmax, instead to being set to the maximum valve working angle VLmax.

Therefore, the ECU 4 performs the process for setting the valve working angle to the initial state value VLini by controlling the drive motor 302 based on the value detected by the slide sensor 314 when the engine 2 is stopped, as the initial state realizing process. When the change of the valve working angle to the initial state value VLini is completed, the initial flag which show the initial state is set to ON and stored in the non-volatile memory.

Accordingly, the valve working angle of the intake valve 2*a* is at the initial state value VLini at least when the engine is being started. The initial state value VLini is obtained based on the exhaust gas re-circulation rate, the intake air efficiency, and the like, due to the valve overlap amount, and varies depending on the type of the engine.

When the initial flag is ON ("YES" in step S102), in step S104, the abnormality diagnosis for the slide sensor 314 is performed. As mentioned in the first embodiment, the slide sensor 314 includes two coils therein for self abnormality diagnosis. Therefore, the ECU 4 can perform the abnormality diagnosis based on the comparison of the outputs from these two coils.

Next, it is determined in step S106 whether there is an abnormality in the slide sensor 314 in the abnormality diagnostic process. When it is determined that there is no abnormality ("NO" in step S106), the valve working angle variable control process for the normal operation time is performed in step S110. Namely, the load factor is calculated based on the operating state of the engine 2 according to the map defined in advance by experiment, and the target valve working angle is set based on the load factor. Then, the process for controlling the drive motor 302 is performed based on the value detected by the slide sensor 314 such that the valve working angle becomes the target valve working angle.

In the case of the cold start, as described in the first embodiment, priority is given to the process for maintaining the valve working angle at the value in the initial state until the warm-up is completed.

When an abnormality has occurred in the slide sensor 314 while the engine 2 is stopped ("YES" in step S106), next, the valve working angle maintaining process for abnormal state is performed in step S108. The valve working angle maintaining process is performed for maintaining the present state in which the valve working angle is at the initial state value VLini. Namely, the valve working angle maintaining process is a process for maintaining the valve working angle at the initial state value VLini without performing the valve working angle variable control process for the normal operation time as described in step S110.

The worm gear 304 is used in the shaft slide mechanism 300. Accordingly, as shown in FIG. 20, it is possible to maintain the initial state value VLini even if electric power supply to the drive motor 302 is stopped. Therefore, the valve working angle maintaining process may be performed only by stopping electric power supply to the drive motor 302 such that the driving force is not generated by the drive motor 302.

However, in this case as well, even when electric power is not supplied to the drive motor 302 due to vibration caused by the operation of the engine during the refuge running, the relative torque between the worm gear 304 and the driven gear 306 may deviate from the non-operation region. Particularly, when the relative torque deviates from the non-operation region in the operation for decreasing the valve working angle due to vibration, there is a possibility that the driven gear 306 is rotated and the valve working angle becomes smaller than the initial state value VLini. In consideration of this, electric power may be supplied to the drive motor 302 such that the torque may be output so that the valve working angle is increased. Namely, the output torque in the range shown by F in FIG. 20 may be generated by the drive motor 302. It is thus possible to further reliably maintain the valve working angle at the initial state value VLini even if vibration has occurred.

As described above, when the valve working angle is maintained at the initial state value VLini, the engine can be started and the refuge running can be performed at the valve working angle of the intake valve 2*a*. Therefore, the engine 2 can be started, and the driver can drive the vehicle to a service garage by the refuge running, by controlling the throttle valve 26 and controlling the amount of furl injected from the fuel injection valve 16.

Since the valve working angle maintaining process is performed in step S108, the valve working angle is maintained at the initial state value VLini even after the engine is started ("YES" in step S102), and the abnormality diagnosis for the slide sensor 314 in step S104 is repeatedly performed. When it is determined that there is an abnormality again ("YES" in step S106), the valve working angle maintaining process in step S108 is continued. When the slide sensor 314 is returned to the normal state, a negative determination is made in step S106. Accordingly, the valve working angle variable control process for the normal operation time is performed in step S110. Thus, when the valve working angle deviates from the value in the initial state, a negative determination is made in step S102, afterwhich the valve working angle variable control process for the normal operation time in step S110 is continued.

Even when the engine is being operated, if a failure has occurred in the valve timing adjusting mechanism 58, the ECU 4 may set the valve working angle to the initial position and the initial flag to ON for the reason described in the first embodiment.

In such a case as well, by making an affirmative determination in step S102, the abnormality diagnosis for the slide sensor 314 is performed in step S104. Therefore, when a failure has occurred in the valve timing adjusting mechanism 58, and further it is determined that an abnormality has occurred in the slide sensor 314, even if the valve timing adjusting mechanism 58 returns to the normal state, the valve working angle maintaining process in step S108 is continued as long as the abnormality in the slide sensor exists.

According to the third embodiment described so far, the following effects can be obtained.

(A) The effects in the descriptions (A) to (C) in the first embodiment can be obtained also in the third embodiment, although the third embodiment differs from the first embodiment in that the worm gear 304 is used in the shaft slide mechanism 300 and the valve working angle is not the maximum value in the refuge running performable region in the third embodiment.

The torque is generated by the drive motor 302 such that the valve working angle is increased in order to suppress vibration during the operation of the engine. In this case as well, the driving force output from the drive motor 302 may be smaller than that of in the normal state. Accordingly, only a small amount of energy is required to generate the torque. In addition, since this small amount of output does not move the control shaft 82, the internal member of the variable valve mechanism 54 and the control shaft 82 are prevented from colliding with the stopper or the like at a high speed. It is therefore possible to increase durability of the variable valve mechanism 54 and prevent a sense of discomfort due to an impulsive sound, which is felt by a driver.

(B) Any valve working angle can be made the value in the initial state according to the relationship shown in FIG. 20. Therefore, flexibility in application is increased regardless of the type of the engine.

Hereafter, a fourth embodiment of the invention will be described in detail. In the embodiment, the valve working angle maintaining process is performed when a failure has occurred in the drive motor 302 shown in FIG. 18. Therefore, instead of the valve working angle control process shown in FIG. 13, the process shown in FIGS. 15 and 16 in the second embodiment is performed. The flow of the process is as shown in FIGS. 15 and 16. However, the contents of the process are different from those in the process shown in FIGS. 15 and 16 since the shaft slide mechanism 300 shown in FIG. 18 is used. Since the other elements are the same as those in the third embodiment, description will be made with reference to FIGS. 1 to 8, and FIGS. 18 to 20.

The valve working angle control process will be described with reference to FIG. 15. The process is repeatedly performed at predetermined time intervals.

When the process is started, it is initially determined in step S202 whether the valve working angle is at the value in the initial state. This is the same as step S102 described in the third embodiment. Namely, when the initial flag is ON ("YES" in step S202), it is then determined in step S204 whether the failure diagnosis for the drive motor 302 has been unperformed since the present valve working angle becomes the initial state value VLini.

When it is determined that the failure diagnosis for the drive motor 302 has been unperformed ("YES" in step S204), the failure diagnostic process for the drive motor 302 is set to be performed in step S206. The failure diagnostic process for the drive motor is performed according to the flow shown in FIG. 16. Next, the failure diagnostic process for the drive motor shown in FIG. 16 will be described.

It is initially determined in step S252 whether the result of the failure diagnosis for the drive motor 302 concerning the operation for increasing the valve working angle shows the normal state. At the start time of the failure diagnosis, no diagnostic result has been obtained ("NO" in step S252). Then, the failure diagnosis for the drive motor 302 concerning the operation for increasing the valve working angle is performed in step S254. In the failure diagnosis for the drive motor 302 concerning the operation for increasing the valve working angle, first, the process for making the drive motor 302 gradually increase the output torque such that the valve working angle is increased is performed. In the case where the drive motor 302 operates normally, when the output torque deviates from the non-operation region to the plus side, as shown in FIG. 20, the valve working angle is increased. Therefore, the process for gradually increasing the output torque is performed until it is confirmed that the valve working angle has been increased by the slide sensor 314. However, even after the estimated time at which the output from the slide sensor 314 reliably changes if the drive motor 302 operates normally, the output toque is returned to "0" unless it is confirmed that the valve working angle has been increased by the slide sensor 314.

Therefore, the ECU 4 determines whether an increase in the valve working angle, which is detected by the slide sensor 314, has occurred by the estimated time. When it is determined that the increased has occurred, the ECU 4 determines that there is no failure in the drive motor 302. On the other hand, when it is determined that the increase has not occurred, the ECU 4 determines that a failure has occurred in the drive motor 302.

After the failure diagnostic process for the drive motor 302 concerning the operation for increasing the valve working angle is started in step S254, it is determined in step S256 whether the failure diagnostic process for the drive motor 302 concerning the operation for increasing the valve working angle has been completed. When it is determined that the failure diagnostic process for the drive motor 302 concerning the operation for increasing the valve working angle has not been completed ("NO" in step S256), the process ends.

In the next control process and the following processes, in the valve working angle control process shown in FIG. 15, an affirmative determination is made in each of steps S202 and S204 and the process in step S206 is repeatedly performed until the diagnosis in the failure diagnostic process for the drive motor is completed. In the failure diagnostic process for the drive motor in FIG. 16, since a negative determination is made in each of steps S252 and S256, the process in step S254 is repeatedly performed.

In the failure diagnostic process for the drive motor in FIG. 16, when the result of the failure diagnosis for the drive motor 302 concerning the operation for increasing the valve working angle is obtained ("YES" in step S256), it is determined in step S258 whether the diagnostic result shows the fact that the drive motor 302 operates normally in the operation for increasing the valve working angle.

When the diagnostic result shows the normal state ("YES" in step S258), the process ends, and an affirmative determination is made in step S252 in the next process. Then, the failure diagnosis for the drive motor 302 concerning the operation for decreasing the valve working angle is performed in step S260. In the failure diagnosis for the drive motor 302 concerning the operation for decreasing the valve working angle, first, the process for making the drive motor 302 gradually increase the output torque such that the valve working angle is decreased is performed. When the drive motor 302 operates normally, as shown in FIG. 20, when the output torque deviates from the non-operation region to the minus side, the valve working angle is decreased. Therefore, the process for gradually increasing the output torque is performed until it is confirmed that the valve working angle has been decreased by the slide sensor 314. However, even after the estimated time at which the output from the slide sensor 314 reliably changes if the drive motor 302 operates normally, the output toque is returned to "0" unless it is confirmed that the valve working angle has been decreased by the slide sensor 314.

After the failure diagnostic process for the drive motor 302 concerning the operation for decreasing the valve working angle is started in step S260, it is determined in step S262 whether the failure diagnosis for the drive motor 302 concerning the operation for decreasing the valve working angle has been completed. When it is determined that the failure diagnosis for the drive motor 302 concerning the operation for decreasing the valve working angle has not been completed ("NO" in step S262), the process ends.

In the next process and the following processes, in the valve working angle control process in FIG. 15, an affirmative determination is made in each of steps S202 and S204 until the diagnosis in the failure diagnostic process for the drive motor is completed, and therefore the process in step S206 is repeatedly performed. Then, in the failure diagnostic process for the drive motor in FIG. 16, an affirmative determination is made in step S252 and a negative determination is made in step S262, and therefore the process in step S260 is repeatedly performed.

In the failure diagnostic process for the drive motor in FIG. 16, when the result of the failure diagnosis for the drive motor 302 concerning the operation for decreasing the valve working angle is obtained ("YES" in step S262), the initial state returning process in step S263 is performed based on the value detected by the slide sensor 314.

The initial state returning process is performed for reliably returning the valve working angle to the value in the initial state. In the failure diagnostic process for the drive motor 302 concerning the operation for decreasing the valve working angle performed immediately before the initial state returning process, when the drive motor 302 is driven normally, the valve working angle should be returned to the initial state value VLini shown in FIG. 19 by offsetting the change in the valve working angle by the failure diagnostic process for the drive motor 302 concerning the operation for increasing the valve working angle performed immediately before the initial state returning process. However, the change in the valve working angle by the failure diagnosis for the drive motor 302 concerning the operation for increasing the valve working angle is not always the same as the change in the valve working angle by the failure diagnosis for the drive motor 302 concerning the operation for decreasing the valve working angle. Particularly, when the valve working angle is smaller than the initial state value VLini, if the state is left as it is, there is a possibility that the engine cannot be started. In order to prevent such a situation, the process for returning the valve working angle to the initial state value VLini is performed by the drive motor 302 in step S263.

When a failure has occurred in the drive motor 302 in the operation for decreasing the valve working angle, the valve working angle is larger than the initial state value VLini. In this case as well, the valve working angle is returned to the initial state value VLini. However, since the valve working angle is large, the valve working need not be returned to the initial state value VLini.

After step S263 is performed, the failure diagnosis is set to be completed in step S264, afterwhich the process ends. When it is determined in step S258 that an abnormality has occurred in the drive motor 302 in the operation for increasing the valve working angle ("NO" in step S258), the failure diagnosis is set to be completed in step S264.

When the result of diagnosis for the drive motor 302 is obtained, in the valve working angle control process in FIG. 15, it is determined that the failure detection process has been performed ("NO" in step S204). Next, it is determined in step S208 whether the diagnostic result shows a failure in the drive motor 302.

When it is determined that a failure has occurred in the drive motor 302, that is, a failure has occurred in the drive motor 302 in one of the operation for increasing valve working angle and the operation for decreasing the valve working angle ("YES" in step S208), next, the valve working angle maintaining process for the abnormal state is performed in step S210. This valve working angle maintaining process is the same as the valve working angle maintaining process in step S108 in the valve working angle control process in FIG. 13 which is described in the third embodiment.

When a failure has occurred, the valve working angle is actually equal to or larger than the initial state value VLini. In the state in which a failure has occurred, the initial flag is kept ON. Therefore, in the next control process and the following processes, an affirmative determination is made in step S202, a negative determination is made in step S204, and an affirmative determination is made in step S208, and therefore the process in step S210 is continued.

When it is determined that there is no failure in the drive motor 302 ("NO" in step S208), the valve working angle variable control process for the normal operation time is performed in step S212. The valve working angle variable control process for the normal operation time is as described in step S110 of the valve working angle control process in FIG. 13 described in the third embodiment.

When there is no failure, the initial flag is set to OFF. Accordingly, in the next process and the following processes of the valve working angle control processes in FIG. 15, a negative determination is made in step S202, and a negative determination is made in step S208, and therefore the process in step S212 is continued.

As mentioned above, when a failure has occurred in the valve timing adjusting mechanism 58, the ECU 4 may set the valve working angle to the initial position, and set the initial flag to "ON". In such a case as well, by making an affirmative determination in step S202, the process which is the same as that at the engine start time is performed.

In the above-mentioned structure, steps S202 and S206 of the valve working angle control process in FIG. 15 and the failure diagnostic process for the drive motor in FIG. 16 can be regarded as the process performed by the failure diagnostic means. Steps S208 and S210 can be regarded as the process performed by the valve state maintaining means.

According to the fourth embodiment described so far, the following effects can be obtained.

(A) The effects in the descriptions (A) and (B) in the third embodiment can be also obtained in the case where a failure has occurred in the drive motor 302.

Hereafter, other embodiments of the invention will be described.

(a) In the embodiments, the minimum valve of the valve working angle is "0". However, the minimum valve of the valve working angle may be a value at which the intake valve 2*a* can open to some extent. In this case as well, the valve working angle appropriate for the engine start is a value larger than the minimum value. It is therefore possible to prevent the situation that the engine cannot be started or the refuge running cannot be performed when a failure has occurred in the sensor or the actuator.

(b) In the embodiments, the slide sensor 50 or 314 is used for detecting the valve working angle. However, the valve working angle may be detected by a rotation angle sensor for detecting a rotational phase of the drive motor 102 or 302, the spiral cam 104 or the reducer 308.

(c) In the fourth embodiment, in the failure diagnosis for the drive motor 302, first, the failure diagnosis for the drive motor 302 concerning the operation for increasing the valve working angle (FIG. 16: step S254) is performed. When it is determined that there is no failure in the drive motor 302 in the operation for increasing the valve working angle, next, the failure diagnosis for the drive motor 302 concerning the operation for decreasing the valve working angle (FIG. 16:

step S260) is performed. Instead of this process, first, the failure diagnosis for the drive motor 302 concerning the operation for decreasing the valve working angle may be performed. When it is determined that there is no failure in the drive motor 302 in the operation for decreasing the valve working angle, next, the failure diagnosis for the drive motor 302 concerning the operation for increasing the valve working angle may be performed. In this case, the valve working angle in the initial state is slightly increased. More particularly, in the initial state, the valve working angle is set to a value which is larger than the lower limit of the valve working angle at which the engine can be started and the refuge running can be performed.

When the failure diagnosis for the drive motor 302 concerning the operation for decreasing the valve working angle is initially performed, and then it is determined that a failure has occurred as the result of the failure diagnosis for the drive motor 302 concerning the operation for increasing the valve working angle, the valve working angle has become smaller than the value in the initial state, and the valve working angle cannot be increased any more. However, the refuge running can be performed at the valve working angle in this state. It is therefore possible to start the engine and perform the refuge running even when the maintaining control is performed.

Figure 21:
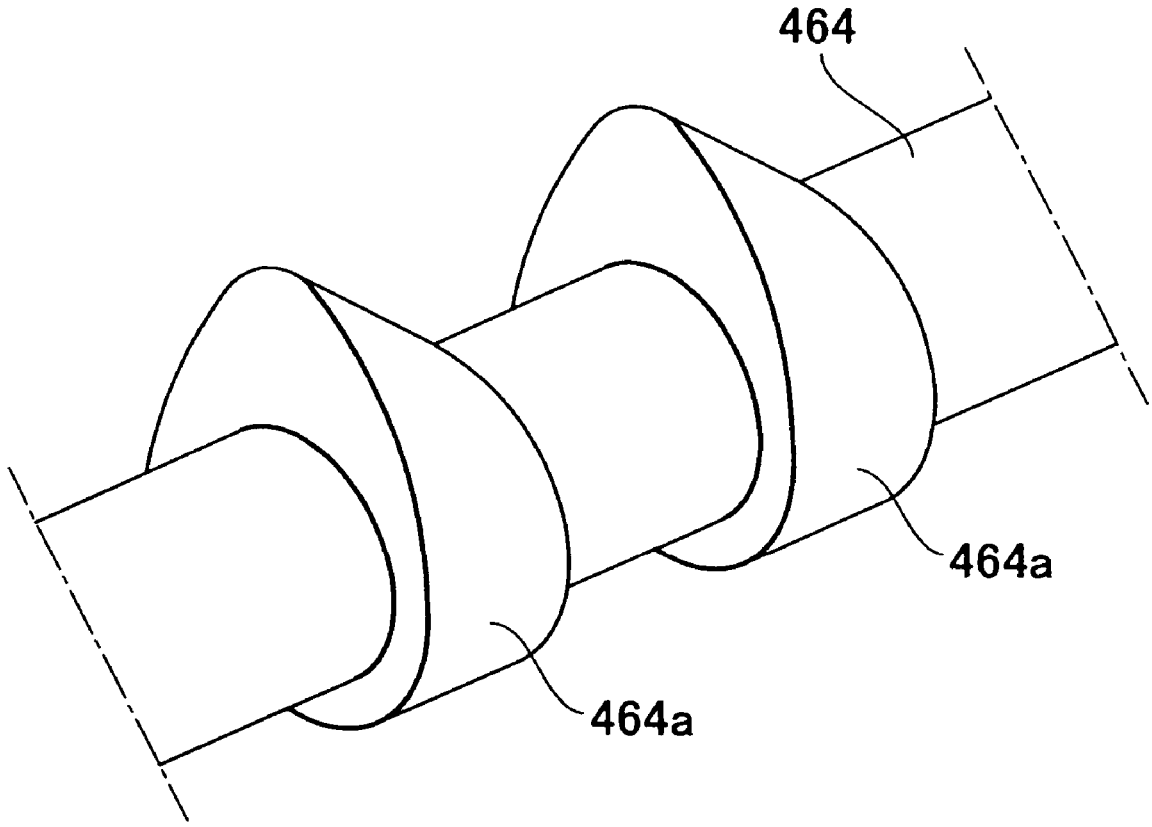
FIG. 21 is a perspective view showing an example of a variable valve system of another engine.

(d) In the embodiments, the intermediary drive mechanism adjusts the valve working angle and the valve lift amount by movement of the control shaft in the axial direction. However, instead of providing the intermediary drive mechanism, the valve working angle and the valve lift amount may be adjusted by employing the structure shown in FIGS. 21 and 22. Namely, an intake cam 464*a* is used as a three-dimensional cam, and an intake cam shaft 464 may also serve as a control shaft and be moved in the axial direction. In this case, a straight spline 464*b* is provided at an end portion of the intake cam shaft 464. The intake cam shaft 464 is engaged with a vane which can adjust the difference in the phase with a short cylindrical formed casing inside of the valve timing adjusting mechanism 58 using the straight spline 464*b*. Therefore, even when the vane cannot move in the axial direction in the short cylindrical formed casing, the intake cam shaft 464 can move in the axial direction.

In this case, the shaft slide mechanism 100 is as described in the first embodiment. However, the cam frame 110 is connected to the intake cam shaft 464 via a ball bearing portion 466. Thus, the cam frame 110 can move the intake cam shaft 464 in the axial direction without rotating with respect to the intake cam shaft 464 which is operated in accordance with rotation of the crankshaft via the valve timing adjusting mechanism 58.

Figure 22A:
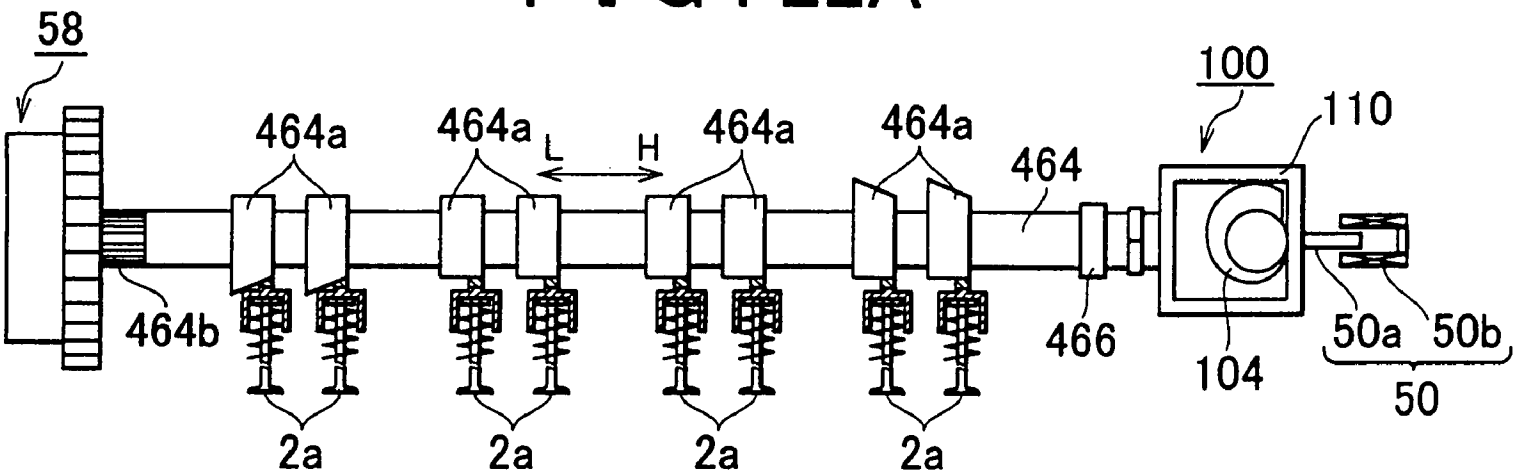
FIGS. 22A and 22B are views each of which describes a driving state of the variable valve system of the other engine.

As shown in FIG. 22A, in the state where the phase of the spiral cam 104 corresponds to the minimum valve working angle, the intake cam shaft 464 is at the limit position in the L direction. Therefore, the intake valve 2*a* is driven by contacting the intake cam 464*a* on the low valve working angle side, and the valve working angle and the valve lift amount become the minimum values.

Starting from the state shown in FIG. 22A, when the spiral cam 104 is rotated by driving the motor, the intake cam shaft 464 moves in the H direction. Thus, the intake valve 2*a* contacts the intake cam 464*a* at a position distant from the low valve working angle side, and the valve working angle and the valve lift amount are gradually increased.

Figure 22B:
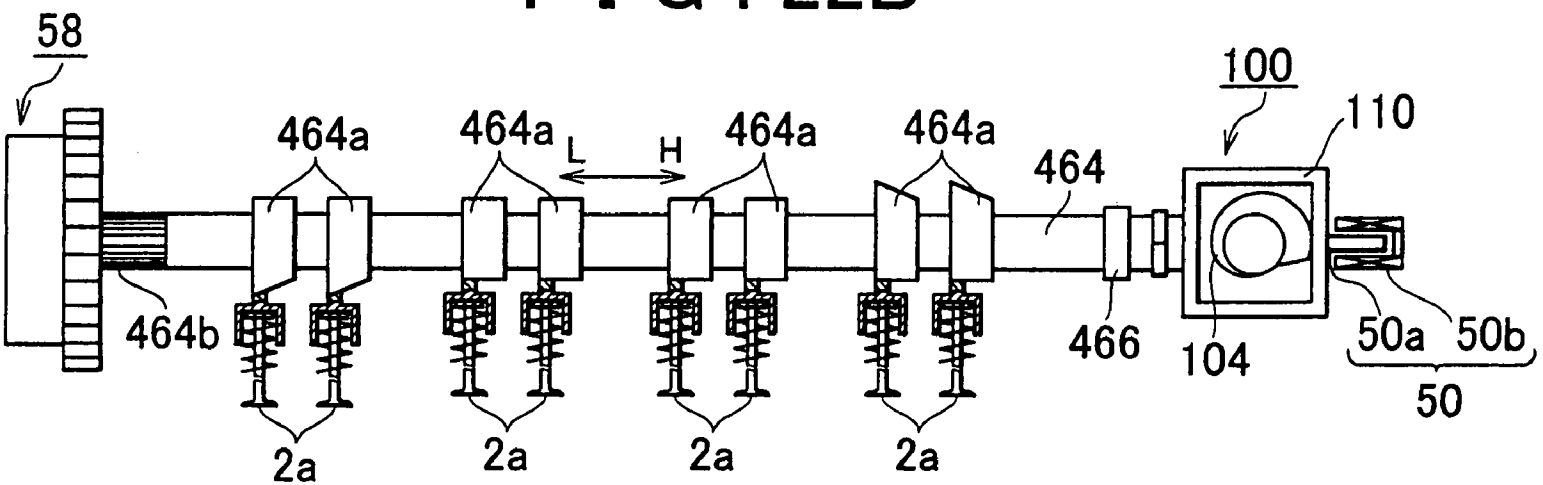

Then, as shown in FIG. 22B, when the phase of the spiral cam 104 corresponds to the maximum valve working angle, the intake cam shaft 464 is at the limit position in the H direction. Accordingly, the intake valve 2*a* is driven by contacting the intake cam 464*a* on the high valve working angle side, and the valve working angle and the valve lift amount become the maximum values.

It is thus possible to adjust the valve working angle and the valve lift amount of the intake valve 2*a*, as shown in FIG. 8. It is therefore possible to perform the failure diagnosis and the maintaining control, as in the first and second embodiments.

Instead of the shaft slide mechanism 100, the shaft slide mechanism 300 using the worm gear, shown in FIG. 18, may be used. It is thus possible to perform the failure diagnosis and the maintaining control as in the third and fourth embodiments.

(e) In the embodiments, as shown in FIG. 8, the valve working angle and the valve lift amount are simultaneously adjusted by the valve working angle adjusting mechanism. However, the valve working angle adjusting mechanism which adjusts only the valve working angle may be used. Alternatively, the valve lift amount adjusting mechanism which adjusts only the valve lift amount may be used.

(f) In the embodiments, the control of the valve working angle and the valve lift amount of the intake valve 2*a* is performed. However, the control can be applied to the case where the valve working angle and/or the valve lift amount of the exhaust valve 2*b* are changed.

(g) In the embodiments, the electric drive motor 102 or 302 is used. However, a hydraulic actuator may be used, and the control shaft 82 may be moved in the axial direction by rotating the spiral cam 104 or the driven gear 306 using a hydraulic pressure.

(h) In the third and fourth embodiments, the initial state value VLini at the engine start time is set to a value in the refuge running performable region which is set when a failure has occurred in the sensor or the actuator. However, the initial state value VLini may be out of the refuge running performable region. For example, the refuge running performable region may be set closer to the maximum valve working angle than the initial state.

(i) The invention is not limited to the variable valve mechanism of a control shaft drive type in the embodiments.

What is claimed is:

1. A failure diagnostic apparatus for a variable valve mechanism that detects a valve characteristic value, which is at least one of a valve lift amount and a valve working angle of an internal combustion engine, by using a sensor, and that adjusts the valve characteristic value, comprising:

a failure diagnostic device which determines whether the valve characteristic value is in a refuge running performable region, which is set in a range where the valve characteristic value can be adjusted by the variable valve mechanism, and performs a failure diagnosis for the variable valve mechanism when it is determined that the valve characteristic value is in the refuge running performable region; and a valve state maintaining device which performs maintaining control for maintaining the valve characteristic value at a value in the refuge running performable region, when the failure diagnostic device determines that a failure has occurred in the variable valve mechanism, the variable valve mechanism includes a control shaft; a control shaft position adjusting mechanism and an actuator which drives the control shaft via the control shaft position adjusting mechanism in order to adjust the valve characteristic value, the variable valve mechanism includes a spiral cam which serves as the control shaft position adjusting mechanism, and moves the control shaft in an axial direction by rotating the spiral cam using the actuator, thereby adjusting the valve characteristic value of the internal combustion engine, the refuge running performable region is a region in which the valve characteristic value is a maximum value, the spiral cam has an arc-shaped surface, whose axis is a rotational axis of the spiral cam, in a cam surface corresponding to the refuge running performable region.

2. The failure diagnostic apparatus according to claim 1, wherein the variable valve mechanism includes a worm gear which serves as the control shaft position adjusting mechanism, and moves the control shaft in an axial direction by rotating the worm gear using the actuator and rotating a driven gear, thereby adjusting the valve characteristic value of the internal combustion engine.

3. A failure diagnostic apparatus for a variable valve mechanism that detects a valve characteristic value, which is at least one of a valve lift amount and a valve working angle of an internal combustion engine, by using a sensor, and that adjusts the valve characteristic value, comprising:

a failure diagnostic device which determines whether the valve characteristic value is in a refuge running performable region, which is set in a range where the valve characteristic value can be adjusted by the variable valve mechanism, and performs a failure diagnosis for the variable valve mechanism when it is determined that the valve characteristic value is in the refuge running performable region;

a valve state maintaining device which performs maintaining control for maintaining the valve characteristic value at a value in the refuge running performable region, when the failure diagnostic device determines that a failure has occurred in the variable valve mechanism, the variable valve mechanism includes a control shaft; a control shaft position adjusting mechanism and an actuator which drives the control shaft via the control shaft position adjusting mechanism in order to adjust the valve characteristic value, the control shaft position adjusting mechanism can maintain the valve characteristic value without using a driving force of the actuator in a state where the valve characteristic value is at least at a value in the refuge running performable region, the valve state maintaining device performs the maintaining control by stopping an output of a driving force from a driving force supply source to the actuator.

4. A failure diagnostic apparatus for a variable valve mechanism that detects a valve characteristic value, which is at least one of a valve lift amount and a valve working angle of an internal combustion engine, by using a sensor, and that adjusts the valve characteristic value, comprising:

a failure diagnostic device which determines whether the valve characteristic value is in a refuge running performable region, which is set in a range where the valve characteristic value can be adjusted by the variable valve mechanism, and performs a failure diagnosis for the variable valve mechanism when it is determined that the valve characteristic value is in the refuge running performable region; and a valve state maintaining device which performs maintaining control for maintaining the valve characteristic value at a value in the refuge running performable region, when the failure diagnostic device determines that a failure has occurred in the variable valve mechanism, the variable valve mechanism includes a control shaft; a control shaft position adjusting mechanism and an actuator which drives the control shaft via the control shaft position adjusting mechanism in order to adjust the valve characteristic value, the valve state maintaining device performs the maintaining control by controlling an output of a driving force from a driving force supply source to the actuator such that a driving force, which is smaller than that in a normal state and which is used for increasing the valve characteristic value, is supplied to the control shaft.

5. A failure diagnostic apparatus for a variable valve mechanism that detects a valve characteristic value, which is at least one of a valve lift amount and a valve working angle of an internal combustion engine, by using a sensor, and that adjusts the valve characteristic value, comprising:

a failure diagnostic device which determines whether the valve characteristic value is in a refuge running performable region, which is set in a range where the valve characteristic value can be adjusted by the variable valve mechanism, and performs a failure diagnosis for the variable valve mechanism when it is determined that the valve characteristic value is in the refuge running performable region;

a valve state maintaining device which performs maintaining control for maintaining the valve characteristic value at a value in the refuge running performable region, when the failure diagnostic device determines that a failure has occurred in the variable valve mechanism, the variable value mechanism includes a control shaft; a control shaft position adjusting mechanism and an actuator which drives the control shaft via the control shaft position adjusting mechanism in order to adjust the valve characteristic value, the failure diagnostic device determines whether a failure has occurred in the actuator, the failure diagnostic device determines whether a failure has occurred in the actuator by driving the actuator such that the valve characteristic value is increased.

6. The failure diagnostic apparatus according to claim 5, wherein the failure diagnostic device determines whether a failure has occurred in the actuator by driving the actuator such that the valve characteristic value is increased, when a driving force is output at a level lower than that at a normal control time of the internal combustion engine.

7. The failure diagnostic apparatus according to claim 6, wherein, in a case where it is determined that the actuator is driven normally in an operation for increasing the valve characteristic, the failure diagnostic device determines whether a failure has occurred in the actuator in an operation for decreasing the valve characteristic value, by driving the actuator such that the valve characteristic value is decreased.

8. A failure diagnostic apparatus for a variable valve mechanism that detects a valve characteristic value, which is at least one of a valve lift amount and a valve working angle of an internal combustion engine, by using a sensor, and that adjusts the valve characteristic value, comprising:

a failure diagnostic device which determines whether the valve characteristic value is in a refuge running performable region, which is set in a range where the valve characteristic value can be adjusted by the variable valve mechanism, and performs a failure diagnosis for the variable valve mechanism when it is determined that the valve characteristic value is in the refuge running performable region; and a valve state maintaining device which performs maintaining control for maintaining the valve characteristic value at a value in the refuge running performable region, when the failure diagnostic device determines that a failure has occurred in the variable valve mechanism, the variable valve mechanism includes a control shaft; a control shaft position adjusting mechanism and an actuator which drives the control shaft via the control shaft position adjusting mechanism in order to adjust the valve characteristic value, the variable valve mechanism includes a worm gear which serves as the control shaft position adjusting mechanism, and moves the control shaft in an axial direction by rotating the worm gear using the actuator and rotating a driven gear, thereby adjusting the valve characteristic value of the internal combustion engine, the refuge running performable region is set to a region whose lower limit is higher than a lower limit of an adjustment position of the valve characteristic value at which refuge running can be performed, the failure diagnostic device determines whether a failure has occurred in the actuator by driving the actuator such that the valve characteristic value is decreased.

9. The failure diagnostic apparatus for a variable valve mechanism according to claim 8, wherein, in a case where it is determined that the actuator is driven normally in an operation for decreasing the valve characteristic value, the failure diagnostic device determines whether a failure has occurred in the actuator in an operation for increasing the valve characteristic value, by driving the actuator such that the valve characteristic value is increased.

* * * * *

UNITED STATES PATENT AND TRADEMARK OFFICE

CERTIFICATE OF CORRECTION

PATENT NO. : 7,424,872 B2
APPLICATION NO. : 11/035078
DATED : September 16, 2008
INVENTOR(S) : Naohide Fuwa et al.

It is certified that error appears in the above-identified patent and that said Letters Patent is hereby corrected as shown below:

| Column | Line | |
|---|---|---|
| 1 | 34 | Before “problem” insert --the--. |
| 9 | 16 | Change “vale” to --valve--. |
| 10 | 2 | Change “toque” to --torque--. |
| 10 | 59 | Change “performs” to --perform--. |
| 12 | 25 | Change “exits” to --exists--. |
| 12 | 28 | Change “time to,” to --time t0,--. |
| 15 | 35 | Change “slightly driving” to --slightly driven--. |
| 18 | 66 | Change “toque” to --torque--. |
| 19 | 25 | Change “show” to --shows--. |
| 21 | 9 | After “than that” delete “of”. |
| 21 | 63 | Change “increase” to --increases--. |
| 22 | 6 | Change “toque” to --torque--. |
| 22 | 12 | Change “increased” to --increase--. |
| 22 | 50 | Change “increase” to --increases--. |
| 22 | 60 | Change “toque” to --torque--. |
| 28 | 28 | Change “value” to --valve--. |

Signed and Sealed this

Thirtieth Day of June, 2009

John Doll

JOHN DOLL
*Acting Director of the United States Patent and Trademark Office*